US007575011B2

(12) United States Patent
Zheng

(10) Patent No.: US 7,575,011 B2
(45) **Date of Patent: *Aug. 18, 2009**

(54) COLLAPSIBLE STRUCTURES

(75) Inventor: Yu Zheng, Covina, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/807,635

(22) Filed: May 30, 2007

(65) Prior Publication Data

US 2007/0246093 A1 Oct. 25, 2007

Related U.S. Application Data

(60) Continuation of application No. 09/618,497, filed on Jul. 18, 2000, now Pat. No. 7,225,822, which is a division of application No. 09/158,333, filed on Sep. 22, 1998, now Pat. No. 6,098,349.

(51) Int. Cl.
*E04H 15/40* (2006.01)

(52) U.S. Cl. ..... 135/126; 135/136; 135/137; 135/117

(58) Field of Classification Search ..... 135/125–126, 135/128, 117, 136–138, 124; 5/418, 414; D21/837, 9; 446/487
See application file for complete search history.

(56) References Cited

U.S. PATENT DOCUMENTS 3,960,161 A * 6/1976 Norman ..... 135/126
4,815,784 A 3/1989 Zheng
5,163,461 A 11/1992 Ivanovich et al.
5,213,147 A 5/1993 Zheng
D341,407 S 11/1993 McLeese
5,385,165 A 1/1995 Hazinski et al.
5,396,917 A 3/1995 Hainski et al.
5,411,046 A 5/1995 Wan
5,439,017 A 8/1995 Brown
5,439,018 A 8/1995 Tsai
5,564,454 A * 10/1996 Curley et al. ..... 135/126
5,592,961 A 1/1997 Chin
5,601,105 A 2/1997 Blen et al.
RE35,571 E 7/1997 McLeese
5,642,538 A 7/1997 McAllister
5,642,750 A 7/1997 Brown et al.
5,645,096 A 7/1997 Hazinski et al.
5,676,168 A 10/1997 Price (Continued)

*Primary Examiner*—Winnie Yip
(74) *Attorney, Agent, or Firm*—Raymond Sun

(57) ABSTRACT

Collapsible structure are provided having a first base panel and a second panel, each having a foldable frame member that has a folded and an unfolded orientation, and a material partially covering the frame member when the frame member is in the unfolded orientation, with the material assuming the unfolded orientation of its associated frame member. The second panel is flexed so that the first and second panels define an interior space, with the second panel having opposing first and second end edges that are coupled to the outer periphery of the first panel. The second panel can have two or more supporting frame members to allow the collapsible structures to be provided in different configurations and sizes. In addition, the first base panel can be replaced by a fabric or similar piece of material that is coupled to the first and second end edges of the second panel. The second panels can be coupled within, or outside, the outer periphery of the first base panel or fabric.

3 Claims, 27 Drawing Sheets

U.S. PATENT DOCUMENTS

| | | | |
|---|---|---|---|
| 5,722,446 | A | 3/1998 | Zheng |
| 5,778,915 | A | 7/1998 | Zheng |
| 5,800,067 | A | 9/1998 | Easter |
| 5,816,278 | A | 10/1998 | Kim |
| D400,949 | S | 11/1998 | Gale |
| D412,354 | S | 7/1999 | Takos |
| D441,040 | S | 4/2001 | Cho |
| 6,216,716 | B1 | 4/2001 | Gobel |
| 6,302,127 | B1 | 10/2001 | Gayton |
| 6,595,227 | B2 | 7/2003 | Le Gette et al. |

* cited by examiner

COLLAPSIBLE STRUCTURES

RELATED CASES

This is a continuation application of Ser. No. 09/618,497, filed Jul. 18, 2000, now U.S. Pat. No. 7,225,822, which is a divisional of Ser. No. 09/158,333, filed Sep. 22, 1998, now U.S. Pat. No. 6,098,349, whose disclosures are incorporated by this reference as though fully set forth herein.

BACKGROUND OF THE INVENTION

1. Field of the Invention

The present invention relates to collapsible structures, and in particular, to collapsible structures having a plurality of panels that can be folded and collapsed to reduce the overall size of the structure.

2. Description of the Prior Art

Collapsible objects have recently become popular with both adults and children. Examples of such collapsible objects are shown and described in U.S. Pat. No. 5,467,794 (Zheng) and U.S. Pat. No. 5,560,385 (Zheng) in the form of collapsible structures. These structures have a plurality of panels which may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Despite their wide-ranging use and applicability, all of the above-mentioned collapsible structures have specific structural configurations that render them better suited for certain applications than others. Therefore, there still remains a need to provide collapsible structures having different structural configurations, so as to increase the variety, use and applicability of these structures. For example, it may be desirable to provide (1) a structure with a stronger support for use in certain applications, or (2) differently-configured panels and frame members that provide a structure with a specific configuration for specific purposes, or (3) a structure with fewer panels to reduce the complexity and cost of the structure, among others.

SUMMARY OF THE DISCLOSURE

In order to accomplish the objects of the present invention, the collapsible structure according to the present invention includes a first base panel and a second panel, each having a foldable frame member that has a folded and an unfolded orientation, and a material partially covering the frame member when the frame member is in the unfolded orientation, with the material assuming the unfolded orientation of its associated frame member. The second panel is flexed so that the first and second panels define an interior space, with the second panel having opposing first and second end edges that are coupled to the outer periphery of the first panel.

In some embodiments of the present invention, the second panel can have two or more supporting frame members to allow the collapsible structures to be provided in different configurations and sizes. In other embodiments of the present invention, the first base panel can be replaced by a fabric or similar piece of material that is coupled to the first and second end edges of the second panel. The second panels can be coupled within, or outside, the outer periphery of the first base panel or fabric.

The collapsible assemblies according to the present invention is convenient for use since they can be easily and quickly folded and collapsed into a smaller size for transportation and storage. The different embodiments provide structures having different configurations having different support and stability, so as to allow structures of different shapes and sizes to be provided, thereby ensuring that the principles of the present invention are applicable to many different applications and uses.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figures 1A, 1B:
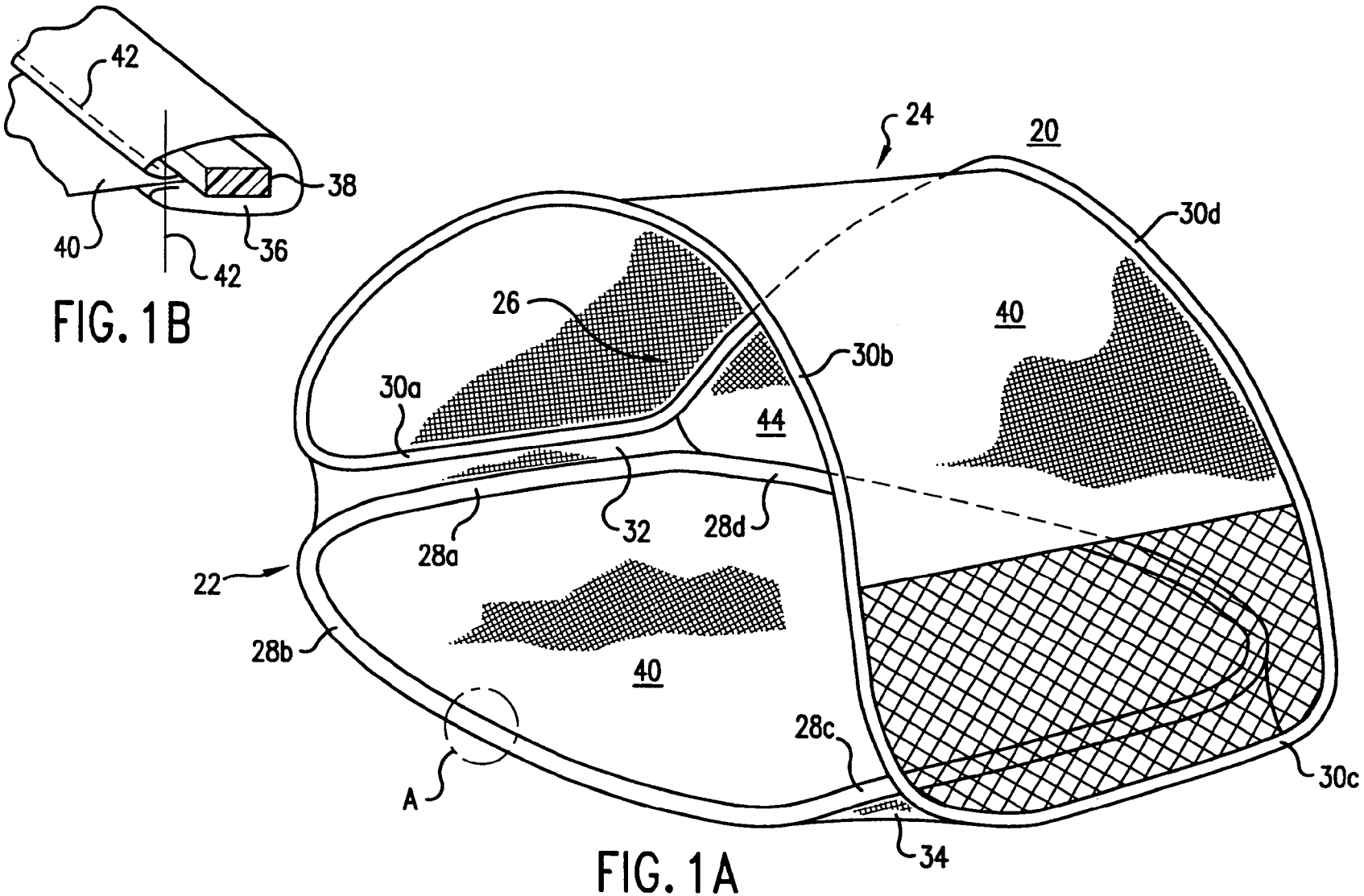
FIG. 1A is a perspective view of a collapsible structure according to a first embodiment of the present invention shown in use in its expanded configuration.
FIG. 1B is a partial cut-away view of the section A of the structure of FIG. 1A illustrating a frame member retained within a sleeve.

FIGS. 1A and 1B illustrates a collapsible structure 20 according to a first embodiment of the present invention. The structure 20 has two separate panels 22 and 24 that are coupled together to form an enclosed space 26. One panel 22 may be a base panel that is adapted to have one side resting on a ground or surface, and the other panel 24 may be a top panel that spans and covers the enclosed space 26. The panel 22 has two opposing end edges 28*a* and 28*c*, and two opposing side edges 28*b* and 28*d* that are connected to the end edges 28*a* and 28*c* to form a generally four-sided configuration. The panel 24 also has two opposing end edges 30*a* and 30*c*, and two opposing side edges 30*b* and 30*d* that are connected to the end edges 30*a* and 30*c* to form a generally four-sided configuration. The end edges 28*a* and 28*c* of the panel 22 are coupled to the end edges 30*a* and 30*c*, respectively, of the panel 24 via two interconnecting fabric pieces 32 and 34 that extend beyond the periphery of the panel 22. The two interconnecting fabric pieces 32 and 34 can be stitched to the end edges 28*a* and 28*c* of the panel 22 and the end edges 30*a* and 30*c* of the panel 24. Although illustrated as being generally four-sided in nature, the panels 22 and 24 can assume any configuration, such as circular, oval, rectangular, square, trapezoidal, or irregular.

Each panel 22, 24 has a continuous frame retaining sleeve 36 provided along and traversing the edges of its sides. A continuous frame member 38 is retained or held within the frame retaining sleeve 36 to support the panel 22, as shown in FIG. 1B. The frame member 38 can be retained around the periphery of the panel 24 in the same manner as illustrated for panel 22.

The continuous frame member 38 of each panel 22, 24 may be provided as one continuous loop, or may be a strip of material connected at both ends to form a continuous loop. The frame members 38 are preferably formed of flexible coilable steel, although other materials such as plastics may also be used. The frame members 38 should be made of a material which is relatively strong and yet is flexible to a sufficient degree to allow it to be coiled. Thus, each frame member 38 is capable of assuming two positions, an open or expanded position such as shown in FIG. 1, or a folded position in which the frame member is collapsed into a size which is much smaller than its open position (see FIG. 4D). The material should have a memory that allows the frame members 38 to spring back to the expanded position when unfolded from the folded position. Each frame member 38 may be merely retained within the respective frame retaining sleeve 36 without being connected thereto. Alternatively, each frame retaining sleeve 36 may be mechanically fastened, stitched, fused, or glued its frame member 38 to retain it in position.

Fabric or sheet material 40 extends across each panel 22, 24, and is held taut by the respective frame members 38 when each panel is in its open position. The term fabric is to be given its broadest meaning and should be made from strong, lightweight materials and may include meshed materials, woven fabrics, sheet fabrics or even films. An example of a meshed material is shown adjacent the end edge 30*c* of the panel 24 in FIG. 1A. The fabric should be water-resistant and durable to withstand the wear and tear associated with rugged outdoor use or rough treatment by children and adults.

As illustrated best in FIG. 1B, the frame retaining sleeve 36 may be attached to the fabric material 40 along the side edges 28*a*-28*d* and 30*a*-30*d* of the panels 22 and 24, respectively. Specifically, the fabric material 40 can be attached to the frame retaining sleeve 36 by a stitching 42 that extends along the side edges 28*a*-28*d*. The stitching 42 can also operate to enclose the frame retaining sleeve 36. Alternatively, the frame retaining sleeve 36 can be a part of or an extension of the fabric material 40, where the side edge of the fabric material 40 is wrapped around the frame member 38 to enclose the frame member 38, and then the stitching 42 applied to enclose the sleeve 36.

Thus, the flexible and coilable nature of the frame member 38 allows the top panel 24 to be flexed so that its end edges 30*a* and 30*c* can be positioned adjacent the end edges 28*a* and 28*c* of the base panel 22. In this regard, the flexing of the top panel 24 obviates the need to otherwise provide a plurality (e.g., at least three) of separate panels to enclose the space 26. The base panel 22 functions to hold the top panel 24 in its flexed configuration. In addition, the fact that the two interconnecting fabric pieces 32 and 34 extend beyond the periphery of the panel 22 allows the top panel 24 to define an enclosed space 26 that is wider than the width (i.e., length of the side edges 28*b* and 28*d*) of the base panel 22. A fabric piece 44 may be stitched or otherwise connected to the side edges 28*d* and 30*d* of the panels 22 and 24, respectively, to form a side wall, with the side edges 28*b* and 30*b* defining an opening for ingress and egress.

Alternatively, the two interconnecting fabric pieces 32 and 34 may lie within the periphery of the panel 22, with the top panel 24 provided in a smaller size to define an enclosed space 26 that is narrower than the width of the base panel 22.

Figure 2A:
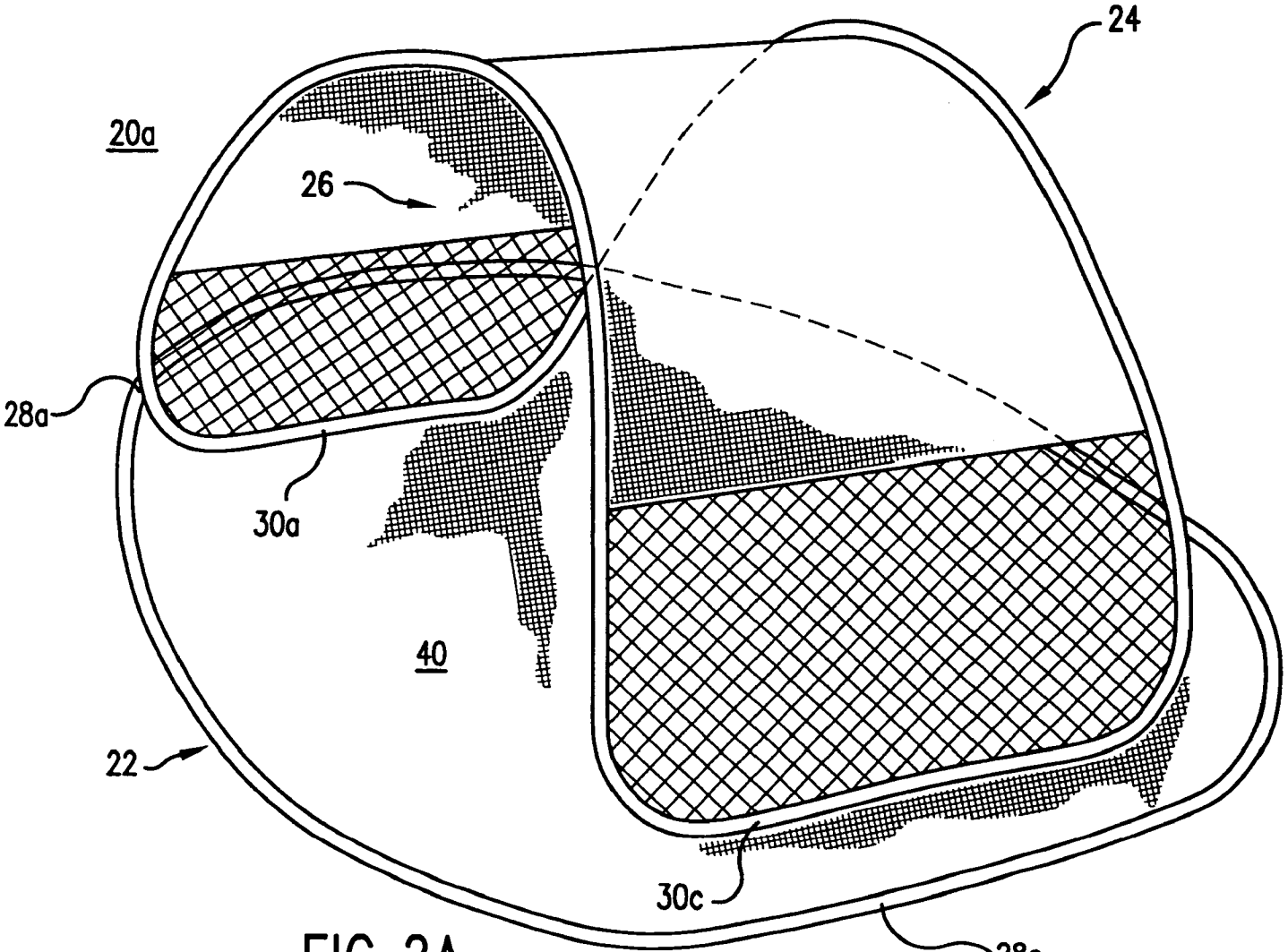
FIG. 2A is a perspective view of a collapsible structure according to a second embodiment of the present invention shown in use in its expanded configuration.

FIG. 2A illustrates a structure 20*a* that is essentially the same as the structure 20, except that the end edges 30*a* and 30*c* of the top panel 24 are attached directly (such as by stitching) to the fabric 40 of the base panel 22 adjacent the end edges 28*a* and 28*c* of the base panel 22, and spaced-apart from the end edges 28*a* and 28*c*. Thus, the structure 20*a* does not have the interconnecting fabric pieces 32 and 34 of structure 20. In addition, the fabric piece 44 may be omitted if desired. Structure 20*a* therefore allows a wider or larger base panel 22 to be provided, with a smaller top panel 24 being used to define an enclosed space 26 that is smaller than and/or different in configuration from the base panel 22. Such a structure 20*a* can be beneficial in applications where the base is desired to be much larger than the enclosed space, such as where the structure 20*a* is to be placed on a rough ground or surface so that it is desirable to provide the users with a larger floor or base panel.

Figure 2B:
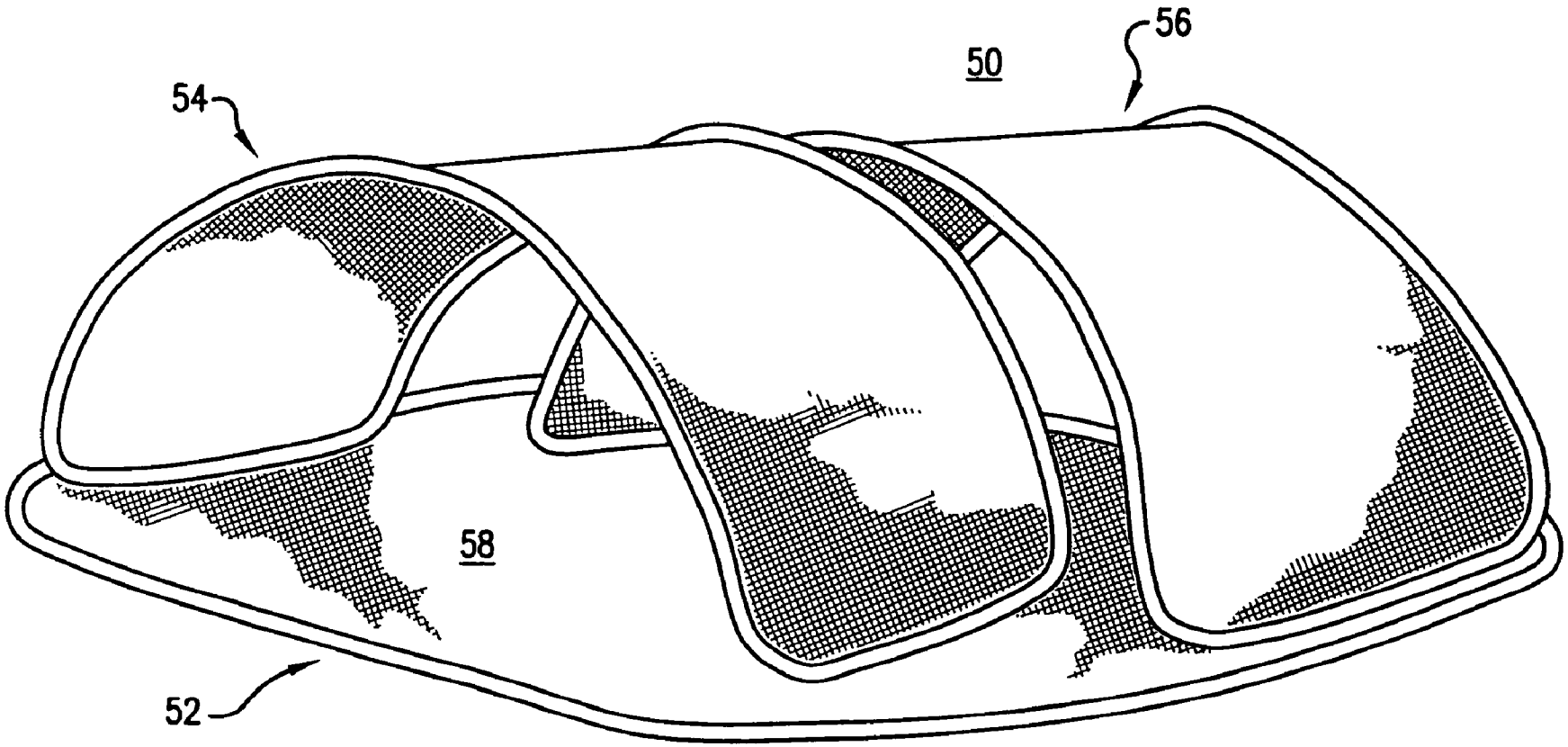
FIG. 2B is a perspective view of a collapsible structure according to a third embodiment of the present invention shown in use in its expanded configuration.

Another benefit of a larger or wider base panel 22 is illustrated in FIG. 2B. In FIG. 2B, the structure 50 has a base panel 52 and two smaller top panels 54 and 56 that are attached to the fabric 58 of the base panel 52 (which is similar to panel 22), thereby allowing two or more top panels 54 and 56 (which are similar to panel 24) to define two or more enclosed spaces on top of the base panel 52 at different locations on the base panel 52. The top panels 54 and 56 can be attached to the base panel 52 in the same manner as described above.

Figure 3A:
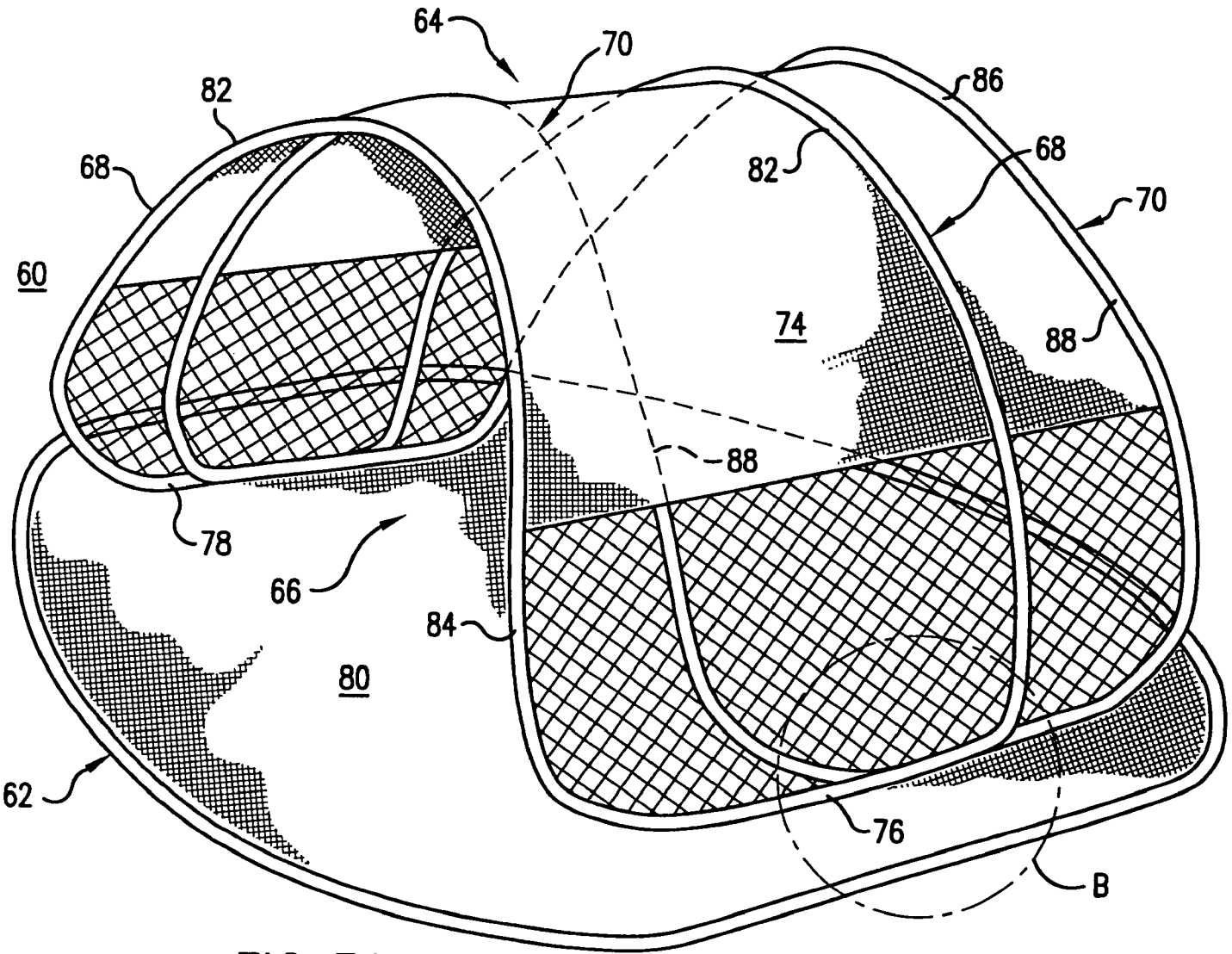
FIG. 3A is a perspective view of a collapsible structure according to a fourth embodiment of the present invention shown in use in its expanded configuration.
Figure 3B:
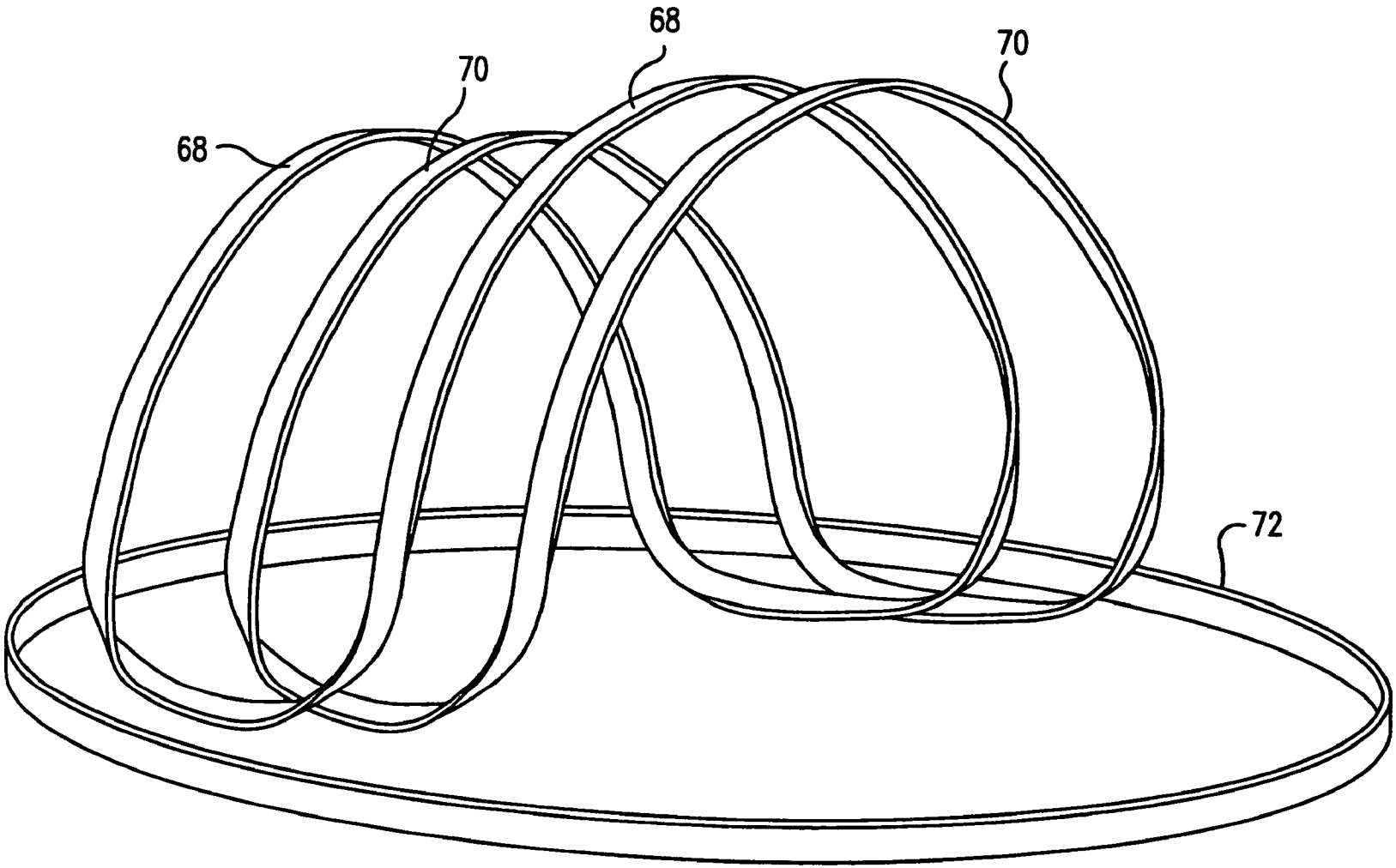
FIG. 3B is a perspective view of the frame members of the structure of FIG. 3A.
Figure 3C:
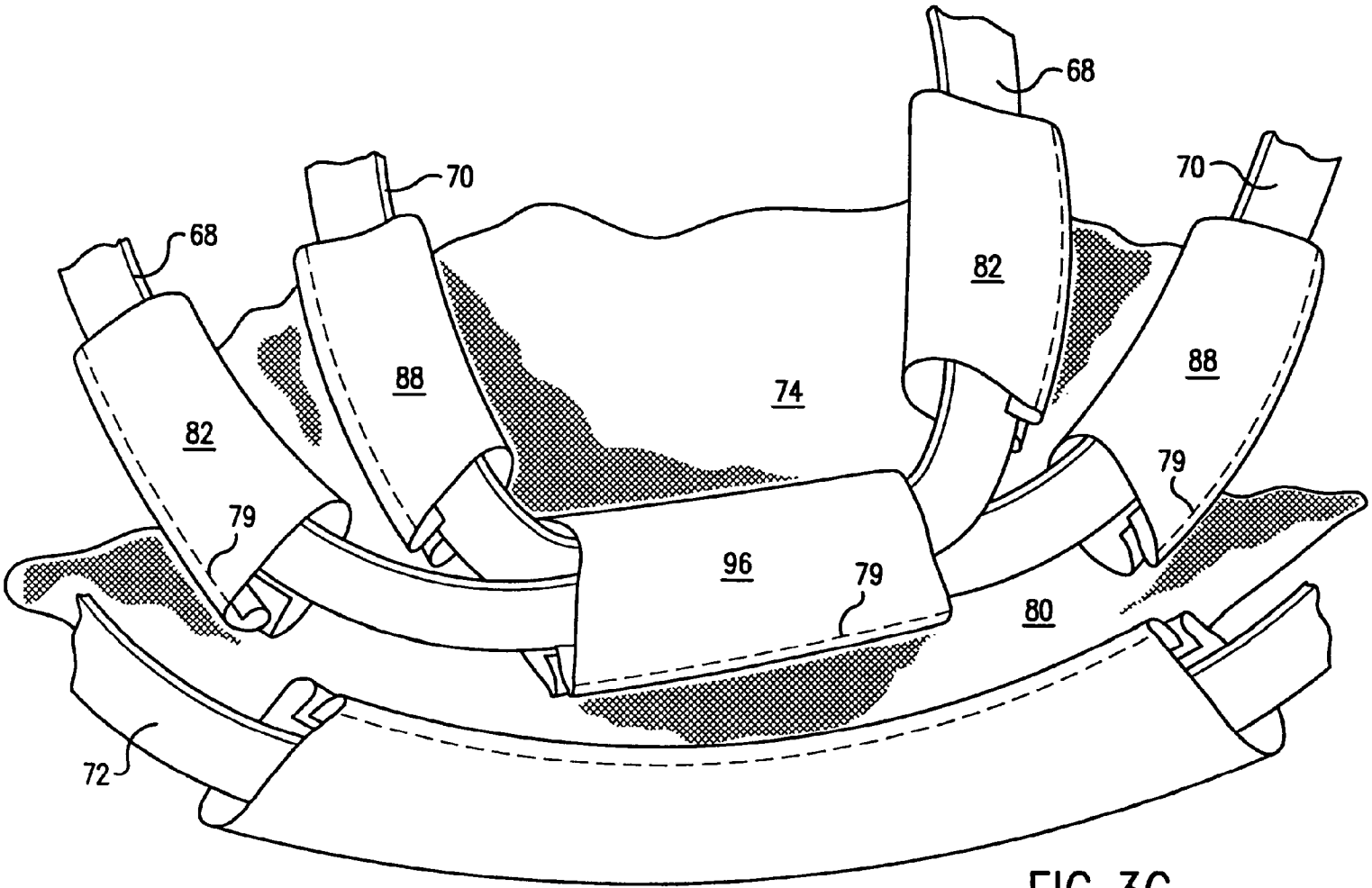
FIG. 3C is a partial cut-away view of the section B of the structure of FIG. 3A.

FIG. 3A illustrates a structure 60 according to a fourth embodiment of the present invention which is similar to structure 20*a*, but which provides an additional frame member to provide more, and in some cases, a different type of, stability and support. The structure 60 has a base panel 62 that can be the same as the base panel 22 of structure 20. A top panel 64 is flexed and extends over the base panel 62 to enclose an internal space 66. The panel 64 is supported by a pair of frame members 68 and 70, instead of merely being supported by one frame member. The frame members 68, 70 can be positioned so that they overlap (i.e., cross) each other, or so that a portion of each frame member 68, 70 is co-extensive with the other frame member. Referring also to FIG. 3C, the panel 64 has a fabric piece 74 that substantially covers the area defined by the crossing frame members 68 and 70. The panel 64 has end edges 76 and 78 that are stitched to the fabric 80 of the base panel 62. A frame retaining sleeve 82 is provided along a first edge 84 of the panel 64 and extends along the end edges 76, 78 and along a portion of the fabric piece 74 between the first edge 84 and a second edge 86 of the panel 64. Similarly, a frame retaining sleeve 88 is provided along the second edge 86 of the panel 64 and extends along the end edges 76, 78 and along a portion of the fabric piece 74 between the first edge 84 and the second edge 86 of the panel 64. Thus, portions of the sleeves 82 and 88 define the outer periphery of the panel 64. As shown in FIG. 3C, the two sleeves 82 and 88 from the first and second edges 84, 86 converge at the end edges 76 and 78 to form a single sleeve 96 which retains both the frame members 68 and 70 along a portion of the end edges 76 and 78 in either an overlapping or co-extensive manner. A portion of each sleeve 82, 88 adjacent the single sleeve 96 can be interrupted (or an opening defined) so that the frame members 68, 70 are exposed thereat. The sleeves 82, 88 and 96 can be formed in the manner explained in connection with FIG. 1B, and may be stitched to the fabric 74.

To assemble the structure 60, the base panel 62 is first provided in the same manner as base panel 22 above. The fabric 74 is cut to its desired shape and then formed with its sleeves 82 and 88, such as by stitching the sleeves 82, 88 to the fabric 74. Thereafter, one frame member 68 is provided in the form of a strip of coilable material, and one end of the frame member 68 is inserted through the sleeve 82 via the opening at either of the end edges 76 and 78. When the entire frame member 68 extends throughout the lumen of the sleeve 82, the ends of the frame member 68 are connected. Then, a second frame member 70 is also provided in the form of a strip of coilable material, and one end of the frame member 70 is inserted through the other sleeve 88 via the opening at either of the end edges 76 and 78. When the entire frame member 70 extends throughout the lumen of the sleeve 88, the ends of the frame member 70 are connected. The resulting panel 64 (with its two frame members 68 and 70 in place) is then flexed and its end edges 76 and 78 attached (such as by stitching 79) to the fabric 80 to obtain the structure 60 shown in FIG. 3A. When so configured, the frame members 68, 70 can be oriented in the manner shown in FIG. 3B in connection with frame member 72 of panel 62, which is shown without the fabric 74 and sleeves 82 and 88.

In addition, a fabric piece (not shown, but can be the same as fabric 44) may be stitched or otherwise connected to the second edge 86 of the panel 64 and the rear edge of the panel 62 to form a side wall, with the first edge 84 defining an opening for ingress and egress into the space 66.

Figure 4A:
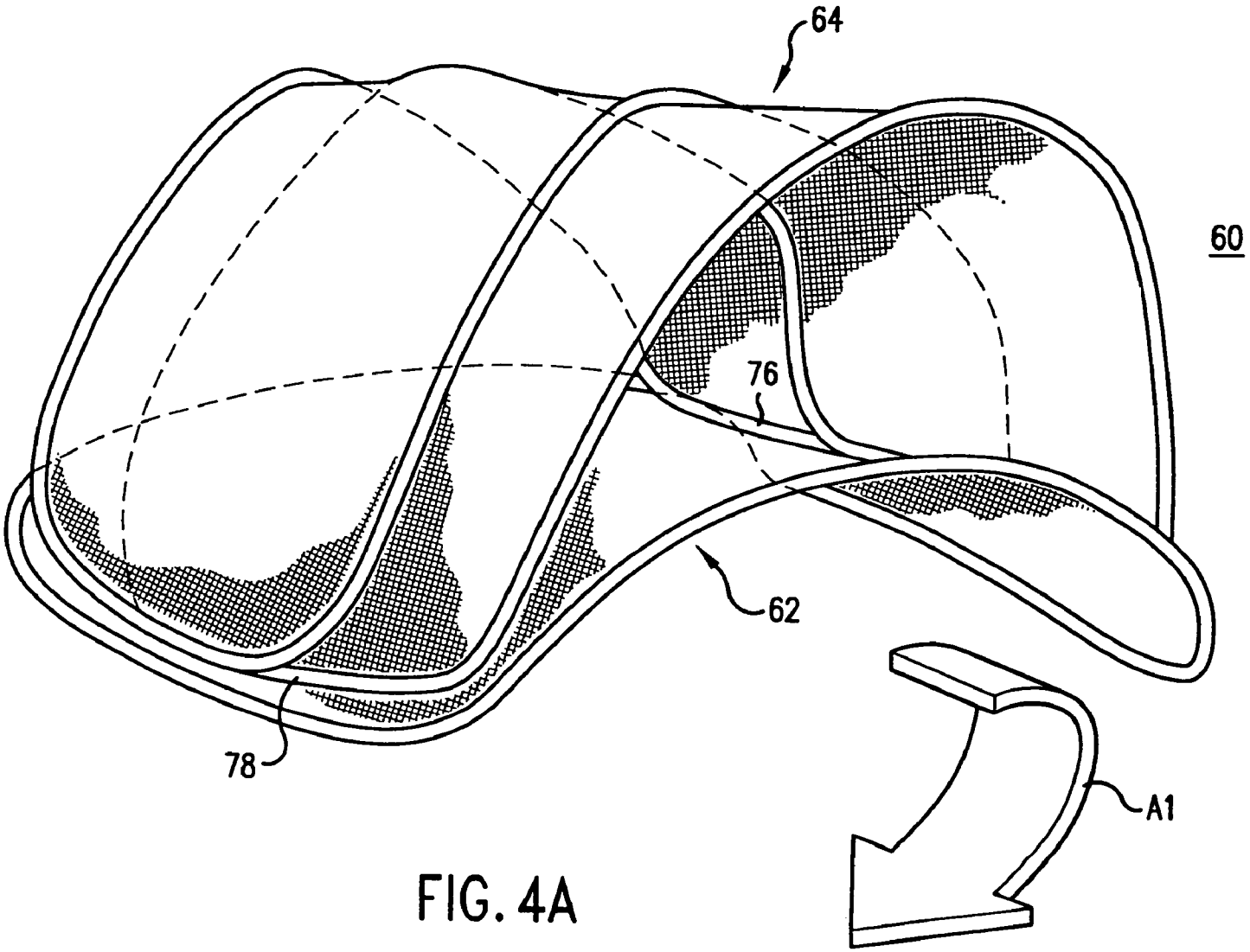
FIGS. 4A-4D illustrate how the structure of FIG. 3A is folded and collapsed from the expanded configuration to a collapsed configuration.
Figure 4B:
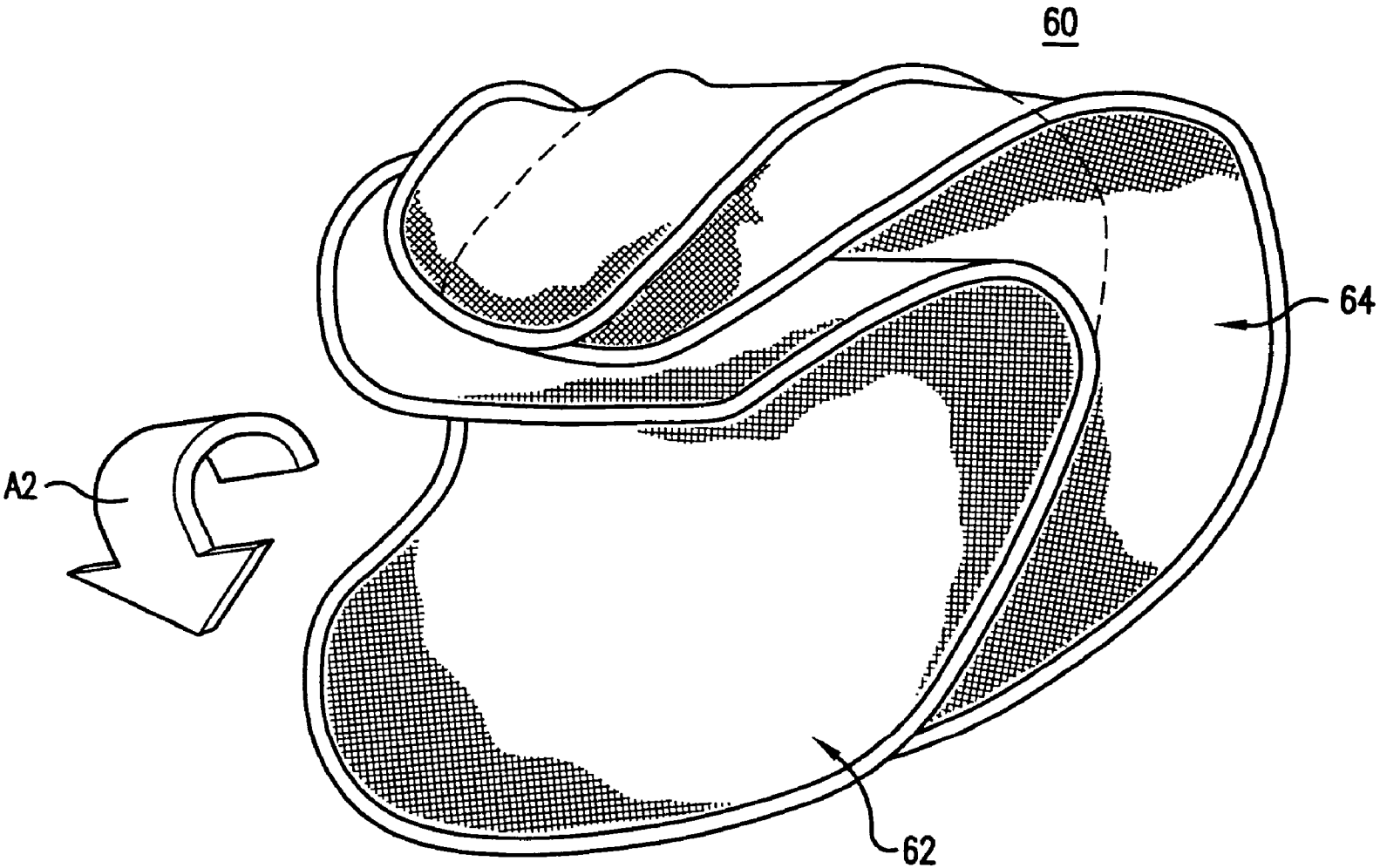
Figure 4C:
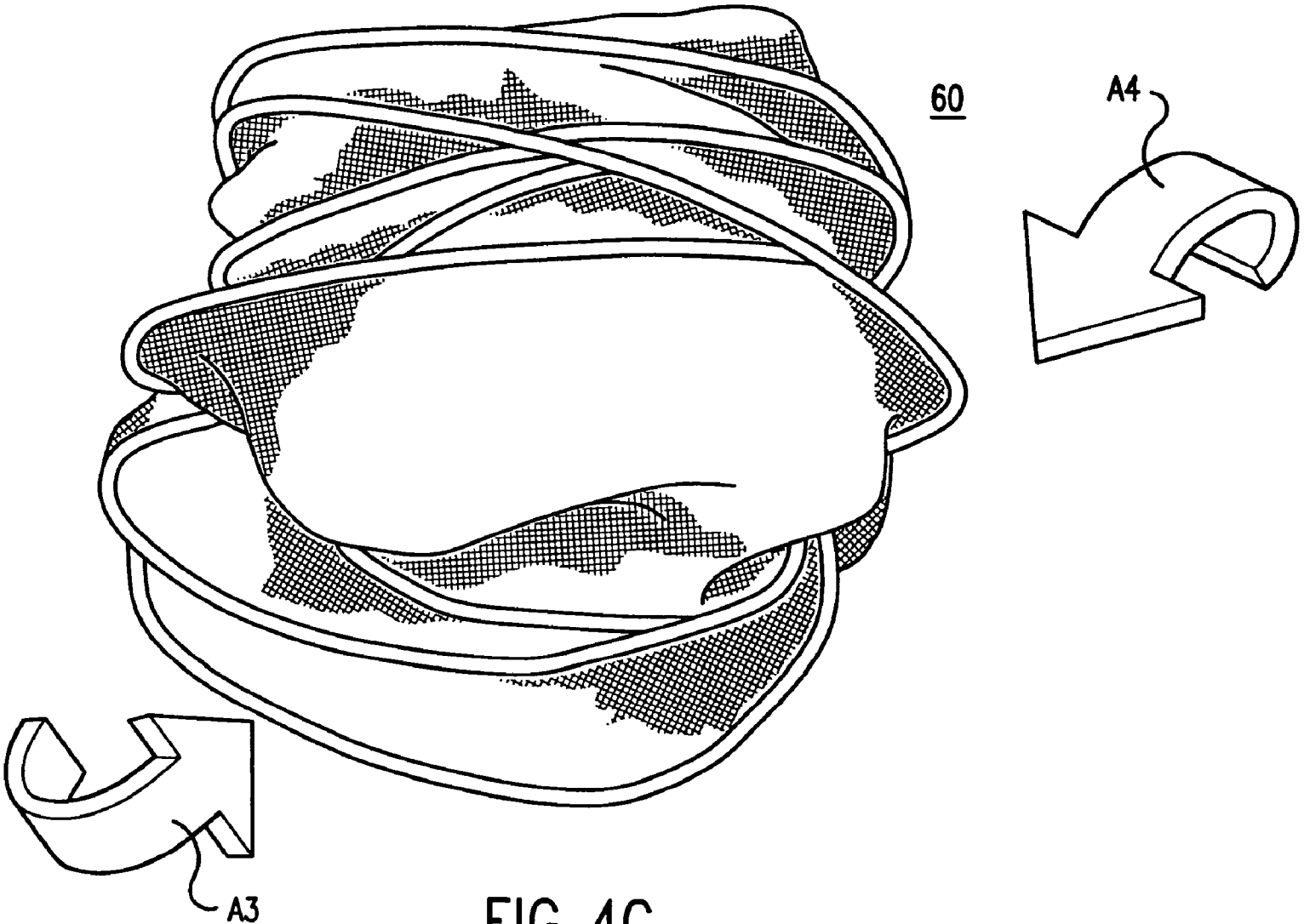
Figure 4D:
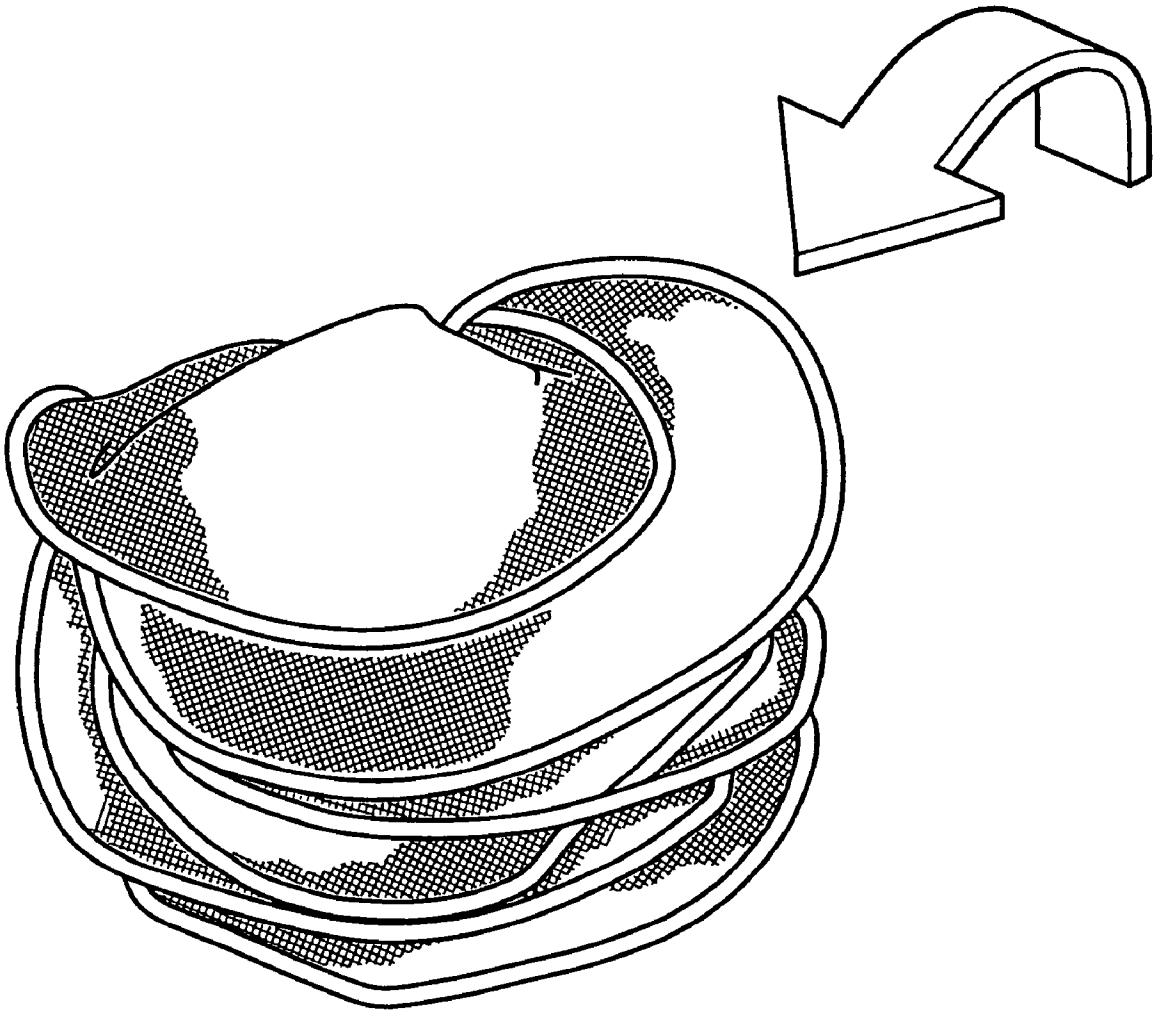

FIGS. 4A-4D illustrate how the structure 60 can be folded and collapsed into a compact configuration for storage. Although the folding and collapsing is illustrated in connection with structure 60, the same principles are applicable to all the other embodiments of the present invention having a base panel (or a fabric piece as the base) and at least one top panel attached to the base panel. First, as shown in FIG. 4A, the opposing ends of the structure 60 (e.g., adjacent the end edges 76, 78) are flexed or twisted towards each other in the direction of arrow A1. As this is being done, the base panel 62 will be flexed and pushed inwardly towards the top panel 64, and the fabric 44 (if present) can be tucked between the panels 62, 64. Further flexing in the direction of arrow A2 will cause the panels 62 and 64 to be collapsed against each other, as shown in FIG. 4B. Then, as shown in FIG. 4C, the opposite ends of the combined stack of panels 62, 64 are twisted and folded (see opposing arrows A3 and A4) to collapse the panels 62, 64. The collapsing is continued so that the initial size of the structure 60 is reduced until the panels 62, 64 are collapsed on each other to provide for a small essentially compact configuration having a plurality of concentric frame members and layers of the fabrics so that the collapsed structure 60 has a size which is a fraction of the size of the initial structure 60, as shown in FIG. 4D. The fact that the base panel 62 (or fabric piece) and the top panel 64 are already somewhat aligned (i.e., one on top of the other) makes the first step of FIG. 4A very easy to carry out. Thus, the configurations of the structures of the present invention may be easier and may require less time to fold and collapse when compared to other known collapsible structures.

To re-open the structure 60 to its expanded configuration, the collapsed panels 62, 64 are unfolded. The memory (i.e., spring-load) of the frame members 68, 70, 72 will cause the frame members to uncoil on their own and to quickly expand the panels 62, 64 to the expanded configuration shown in FIG. 3A. The same principle can be applied to re-open all the other embodiments of the present invention.

The structure 60 is especially well-suited in applications where the top panel 64 is to be larger or wider. The two crossing frame members 68, 70 of the top panel 64 provides support and stability to the top panel 64 since the crossing of frame members imparts greater structural stability to the location(s) where the frame members cross.

Figure 5A:
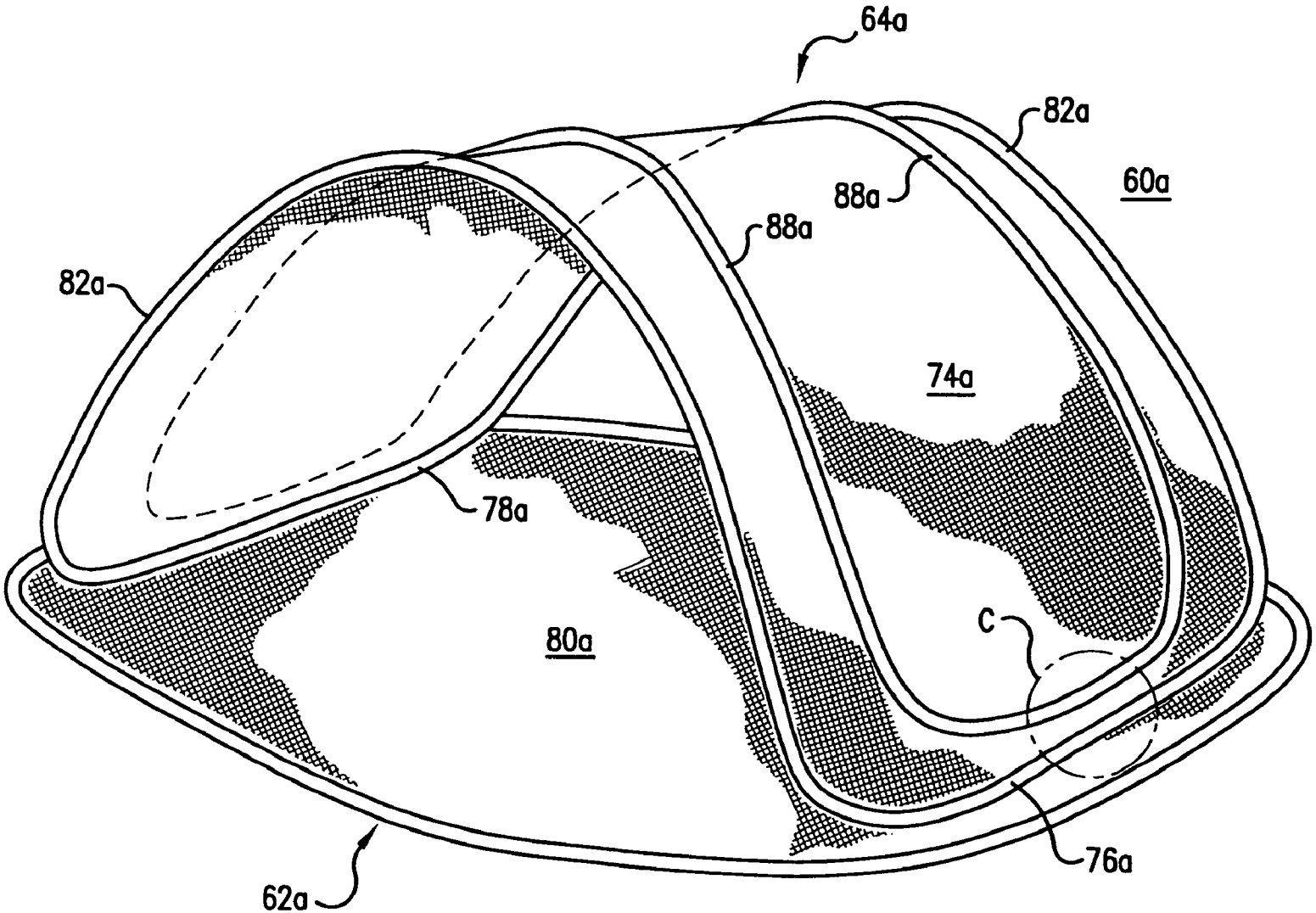
FIG. 5A is a perspective view of a collapsible structure according to a fifth embodiment of the present invention shown in use in its expanded configuration.
Figure 5B:
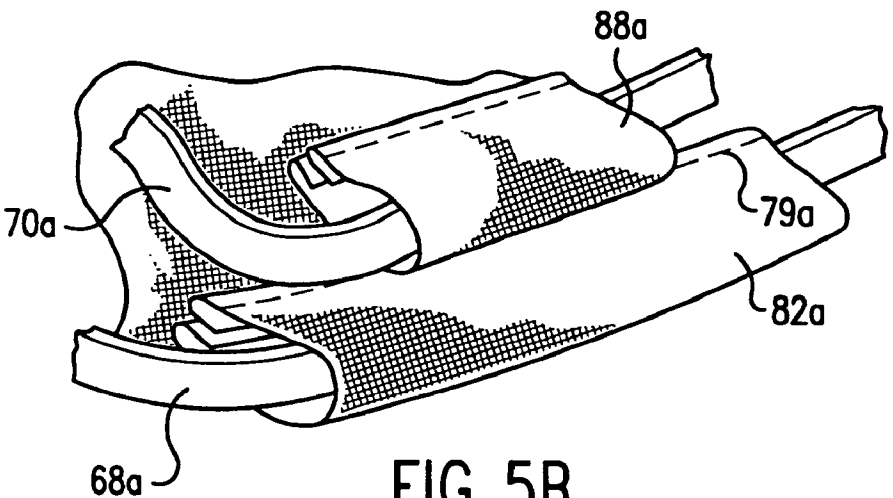
FIG. 5B is a partial cut-away view of the section C of the structure of FIG. 5A.

FIG. 5A illustrates a structure 60*a* according to a fifth embodiment of the present invention which is similar to structure 60, but which orients its frame members differently. The elements of the structure 60*a* that are the same as the elements of the structure 60 are provided with the same numeral designations except that an "a" has been added to the numeral designations in FIG. 5A. The primary difference between structures 60 and 60*a* is that the frame members 68*a* and 70*a* in structure 60*a* are not crossing. Instead, as shown in FIGS. 5A and 5B, the frame member 68*a* and its sleeve 82*a* define the periphery (i.e., side edges) of the panel 64*a*, and the frame member 70*a* is smaller than frame member 68*a* and its sleeve 88*a* is provided on the fabric 74*a* spaced-apart from and inside the periphery of the frame member 68*a*. Thus, frame member 70*a* functions to provide additional support to the interior portions of the panel 64*a*.

The panel 64*a* can be assembled in a similar manner as panel 64. The fabric 74*a* is formed with its sleeves 82*a*, 88*a*, with an opening provided at any location of each sleeve 82*a*, 88*a*. Thereafter, one frame member 68*a* is provided in the form of a strip of coilable material, and one end of the frame member 68*a* is inserted through the sleeve 82*a* via its opening. When the entire frame member 68*a* extends through the lumen of the sleeve 82*a*, the ends of the frame member 68*a* are connected. A second frame member 70*a* is inserted through the other sleeve 88*a* in the same manner. The panel 64*a* is then flexed and its end edges 76*a* and 78*a* attached (such as by stitching 79*a*) to the fabric 80*a* to obtain the structure 60*a* shown in FIG. 5A.

Figure 6B:
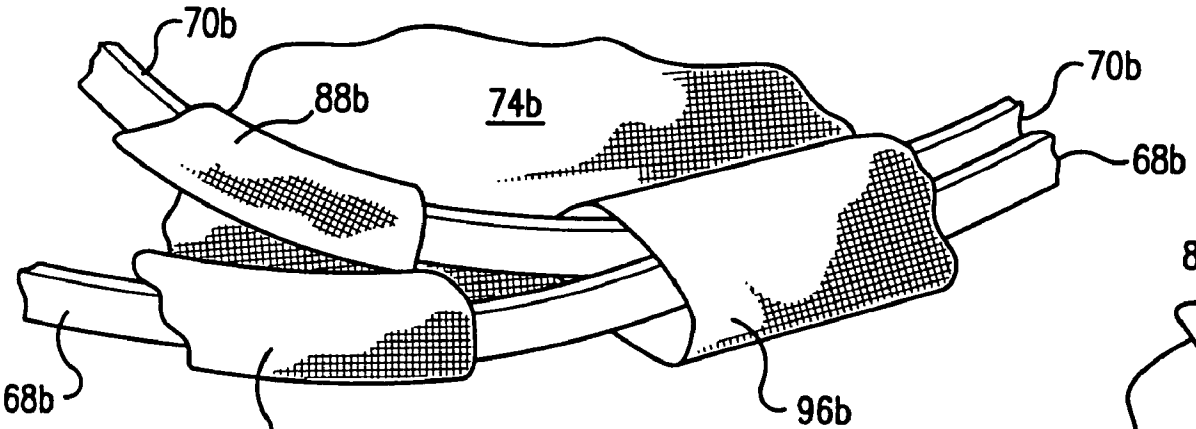
FIG. 6B is a partial cut-away view of the section D of the structure of FIG. 6A.
Figure 6A:
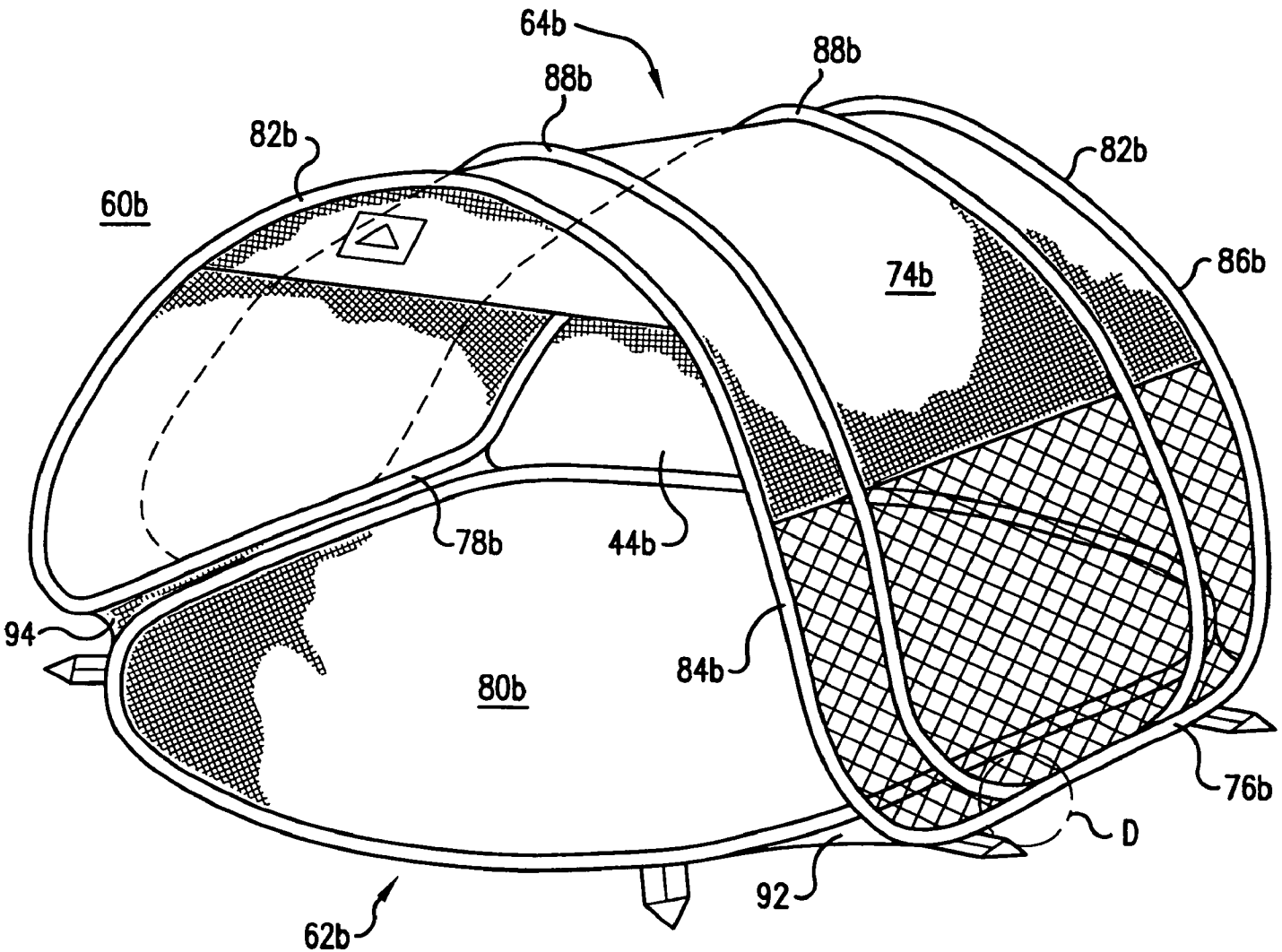
FIG. 6A is a perspective view of a collapsible structure according to a sixth embodiment of the present invention shown in use in its expanded configuration.

FIG. 6A illustrates a structure 60*b* according to a sixth embodiment of the present invention which is similar to structure 60*a*, but which has the end edges 76*b* and 78*b* attached to the base panel 62*b* via interconnecting fabrics 92 and 94, respectively, instead of directly attaching the end edges 76*b* and 78*b* to the fabric 80*b*. The elements of the structure 60*b* that are the same as the elements of the structure 60*a* are provided with the same numeral designations except that a "b" has been added to the numeral designations in FIG. 6A. In this regard, the principles underlying the structure 60*b* are similar to those for structure 20 of FIG. 1A, with the interconnecting fabrics 92 and 94 being essentially the same as the interconnecting fabrics 34 and 32, respectively, in FIG. 1A. Fabric 44*b* can also be attached to the second edge 86*b* to form a fabric wall.

In addition, the sleeves 82*b* and 88*b* are slightly different from the sleeves 82*a* and 88*a* of FIG. 5A. As with structure 60*a*, the sleeve 82*b* defines the periphery of the panel 64*b*, and the sleeve 88*b* is provided on the fabric 74*b* inside the periphery of the frame member 68*b*. However, as shown in FIG. 6B, the two sleeves 82*b* and 88*b* from the first and second edges 84*b*, 86*b* converge at the end edges 76*b* and 78*b* to form a single sleeve 96*b* which retains both the frame members 68*b* and 70*b* along a portion of the end edges 76*b* and 78*b*. As shown in FIG. 6B, a portion of each sleeve 82*b*, 88*b* adjacent the single sleeve 96 can be interrupted (or an opening defined) so that the frame members 68*b*, 70*b* are exposed thereat, or the portion of each sleeve 82*b*, 88*b* adjacent the single sleeve 96 can be stitched together to join or communicate with the single sleeve 96. By causing the two frame members 68*b*, 70*b* to be positioned side-by-side along a portion of the end edges 76*b*, 78*b*, the frame members 68*b*, 70*b* provide additional support and stability to the base of the structure 60*b*. However, since the frame members 68*b*, 70*b* do not cross (compared with structure 60 of FIG. 3A), the width of the top panel 64*b* would not be expected to be as wide as or greater than the width of top panel 64, so the structure 60*b* is better suited for use with a top panel 64*b* having a smaller width.

Figure 7A:
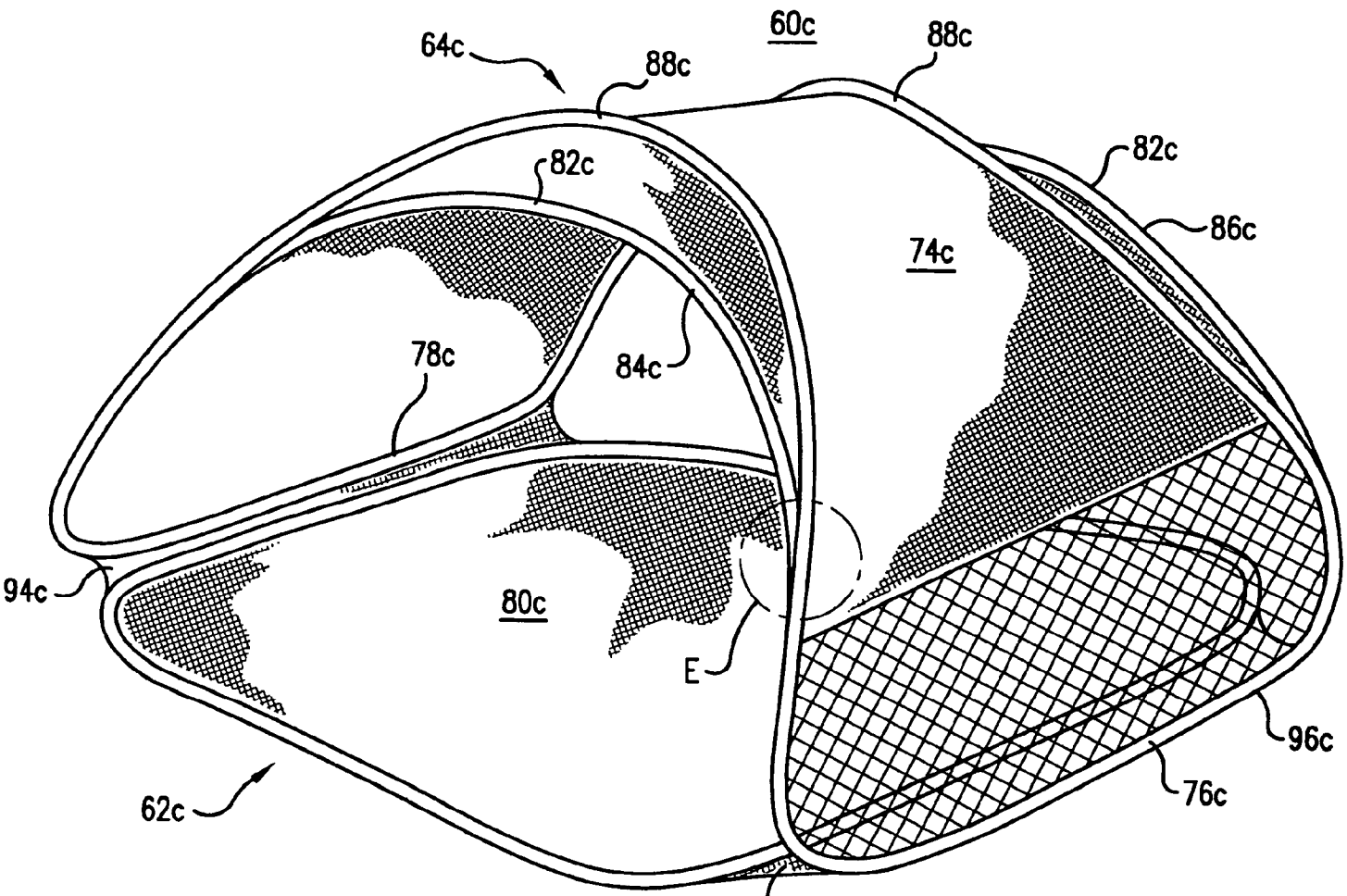
FIG. 7A is a perspective view of a collapsible structure according to a seventh embodiment of the present invention shown in use in its expanded configuration.
Figure 7B:
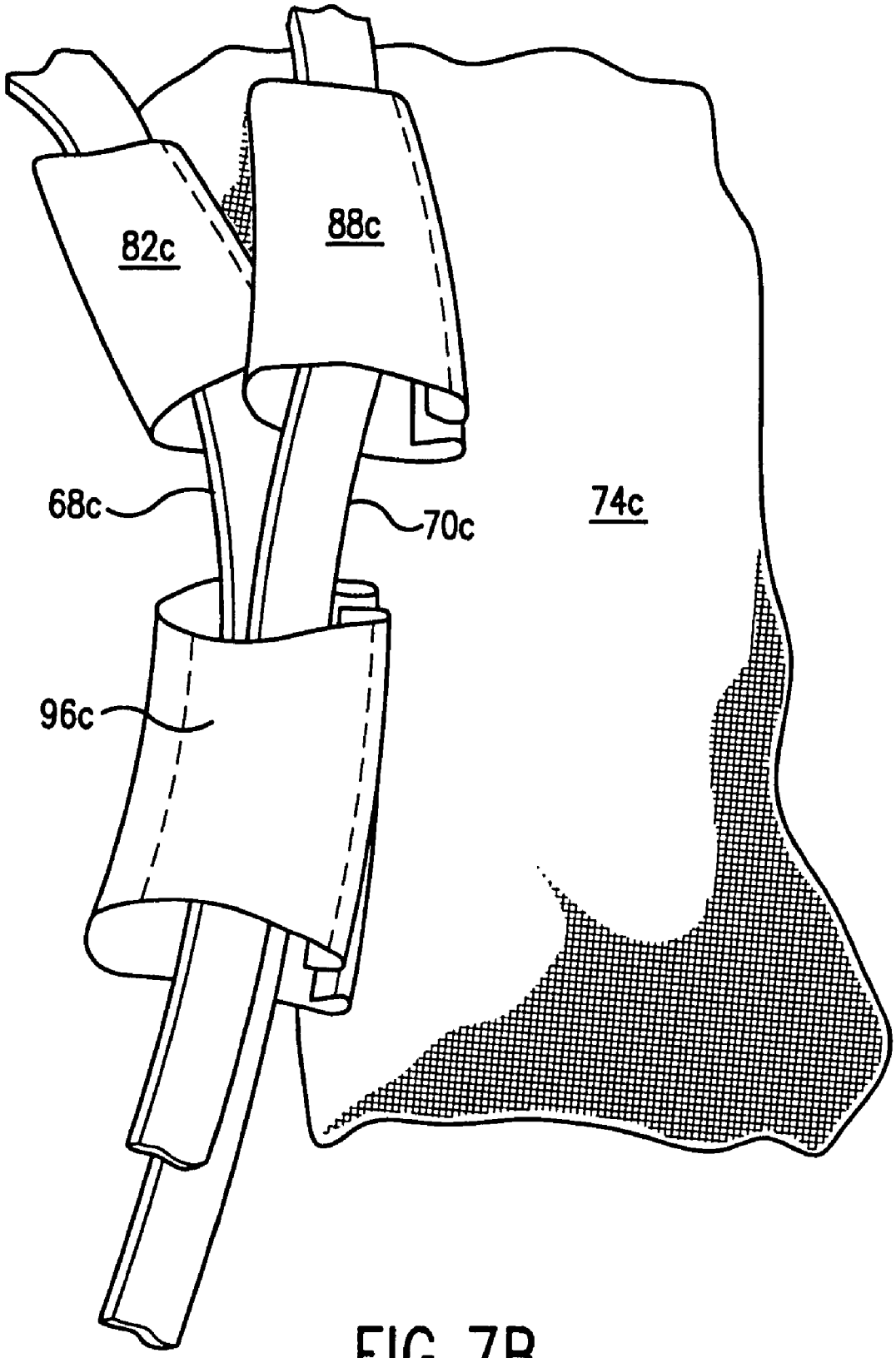
FIG. 7B is a partial cut-away view of the section E of the structure of FIG. 7A.

FIG. 7A illustrates a structure 60*c* according to a seventh embodiment of the present invention which employs the principles of structure 60*b*, but which also provides a more stable support that may be needed for larger structures or tents. The elements of the structure 60*c* that are the same as the elements of the structure 60*b* are provided with the same numeral designations except that a "c" has been added to the numeral designations in FIG. 7A. The panel 64*c* still has two sleeves 82*c* and 88*c* that retain separate frame members 68*c* and 70*c*, but these sleeves 82*c*, 88*c* converge to the single sleeve 96*c* along the first and second edges 84*c*, 86*c* of panel 64*c*, so that the single sleeve 96*c* extends along lower portions of the first and second edges 84*c*, 86*c* and along the entire end edges 76*c* and 78*c*. As shown in FIG. 7B, a portion of each sleeve 82*c*, 88*c* adjacent the single sleeve 96*c* can be interrupted (or an opening defined) so that the frame members 68*c*, 70*c* are exposed thereat, or the portion of each sleeve 82*c*, 88*c* adjacent the single sleeve 96*c* can be stitched together to join or communicate with the single sleeve 96*c*. By causing the two frame members 68*c*, 70*c* to be positioned side-by-side (i.e., co-extensively) along lower portions of the first and second edges 84*c*, 86*c* and along the entire end edges 76*c*, 78*c*, the frame members 68*c*, 70*c* provide more support and stability to the base of the structure 60*c* than that provided by the structure 60*b*.

Figure 8B:
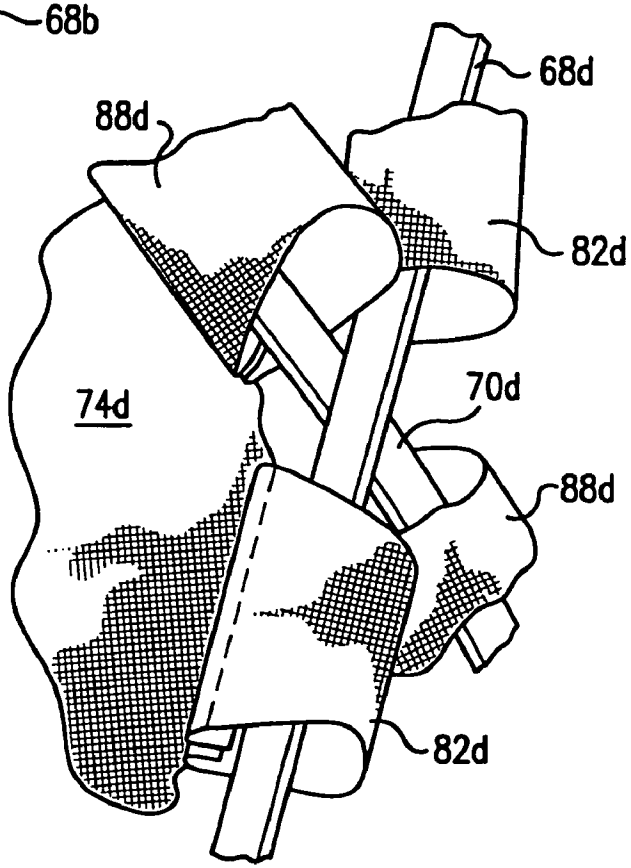
FIG. 8B is a partial cut-away view of the section F of the structure of FIG. 8A.
Figure 8A:
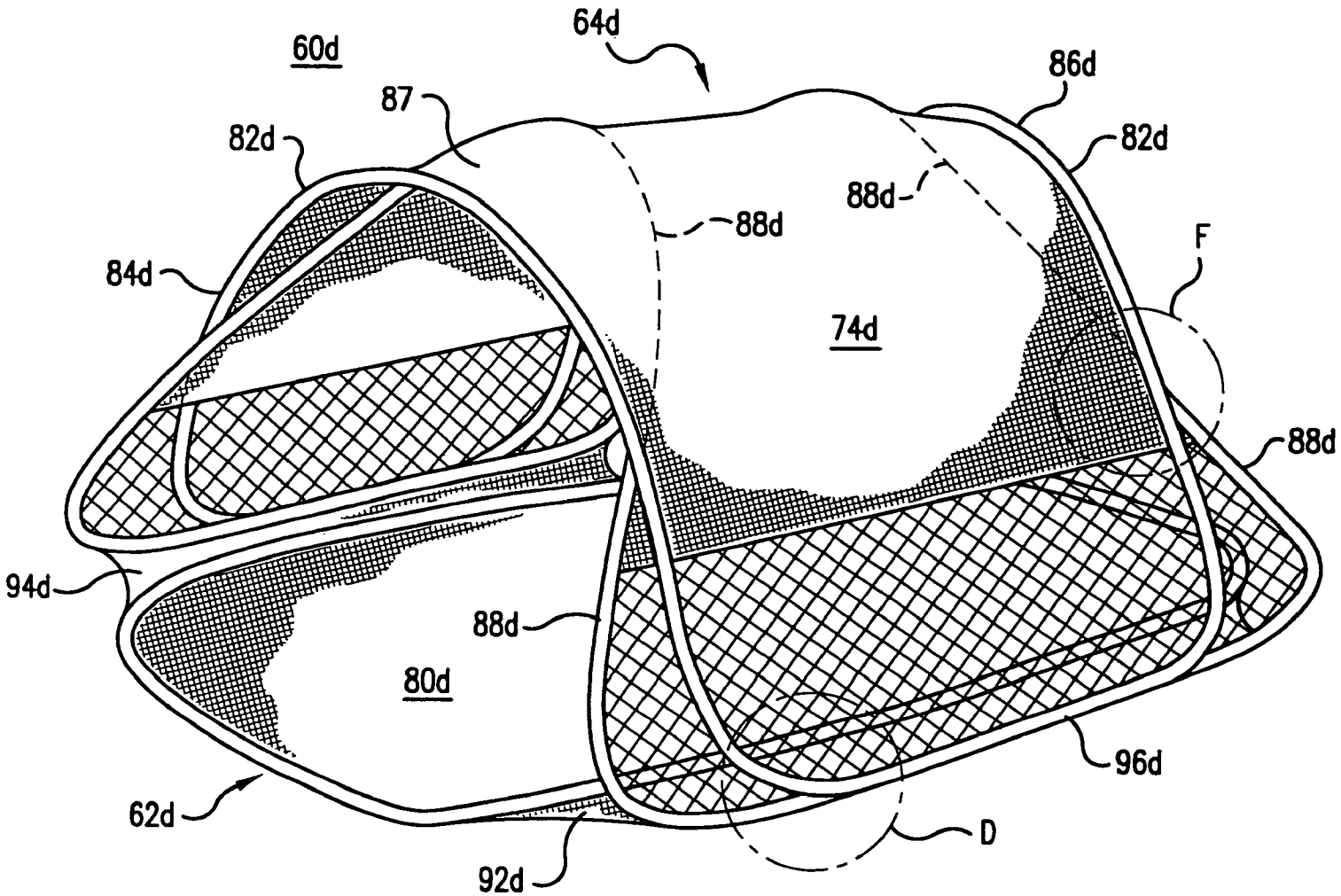
FIG. 8A is a perspective view of a collapsible structure according to an eighth embodiment of the present invention shown in use in its expanded configuration.

FIG. 8A illustrates a structure 60*d* according to an eighth embodiment of the present invention which employs the principles of structures 60*b* and 60*c*, while providing for a different type of support for the structure 60*d*. The elements of the structure 60*d* that are the same as the elements of the structures 60*b* and 60*c* are provided with the same numeral designations except that a "d" has been added to the numeral designations in FIG. 8A. The panel 64*d* also has two sleeves 82*d* and 88*d* that retain separate frame members 68*d* and 70*d*, and these sleeves 82*d* and 88*d* also converge to form a single sleeve 96*d* along a portion of the end edges 76*d* and 78*d* in the manner shown in FIG. 6B. In this regard, the section D in FIG. 8A can be the same as that illustrated in FIG. 6B. However, these sleeves 82*d*, 88*d* also cross each other at opposing locations along the first and second edges 84*d*, 86*d* of panel 64*d*, so that the corresponding frame members 68*d*, 70*d* cross or overlap each other at these locations. As shown in FIG. 8B, a portion of each sleeve 82*d*, 88*d* adjacent the crossing location can be interrupted (or an opening defined) so that the frame members 68*d*, 70*d* are exposed thereat. In addition, the first and second edges 84*d* and 86*d* are defined by both sleeves 82*d*, 88*d*: by the sleeve 82*d* at top portions thereof and by the sleeve 88*d* at bottom portions thereof. By causing the two frame members 68*c*, 70*c* to be positioned side-by-side along a portion of the end edges 76*c*, 78*c*, and to be overlapped at opposing locations along the first and second edges 84*d*, 86*d*, the frame members 68*d*, 70*d* also provide support and stability to different parts of the structure 60*d* (e.g., the central parts of the first and second edges 84*d*, 86*d*), as well as allowing the structure 60*d* to define a canopy-like extension 87 at the top of the structure 60*d* between the sleeves 82*d* and 88*d*.

Figure 9:
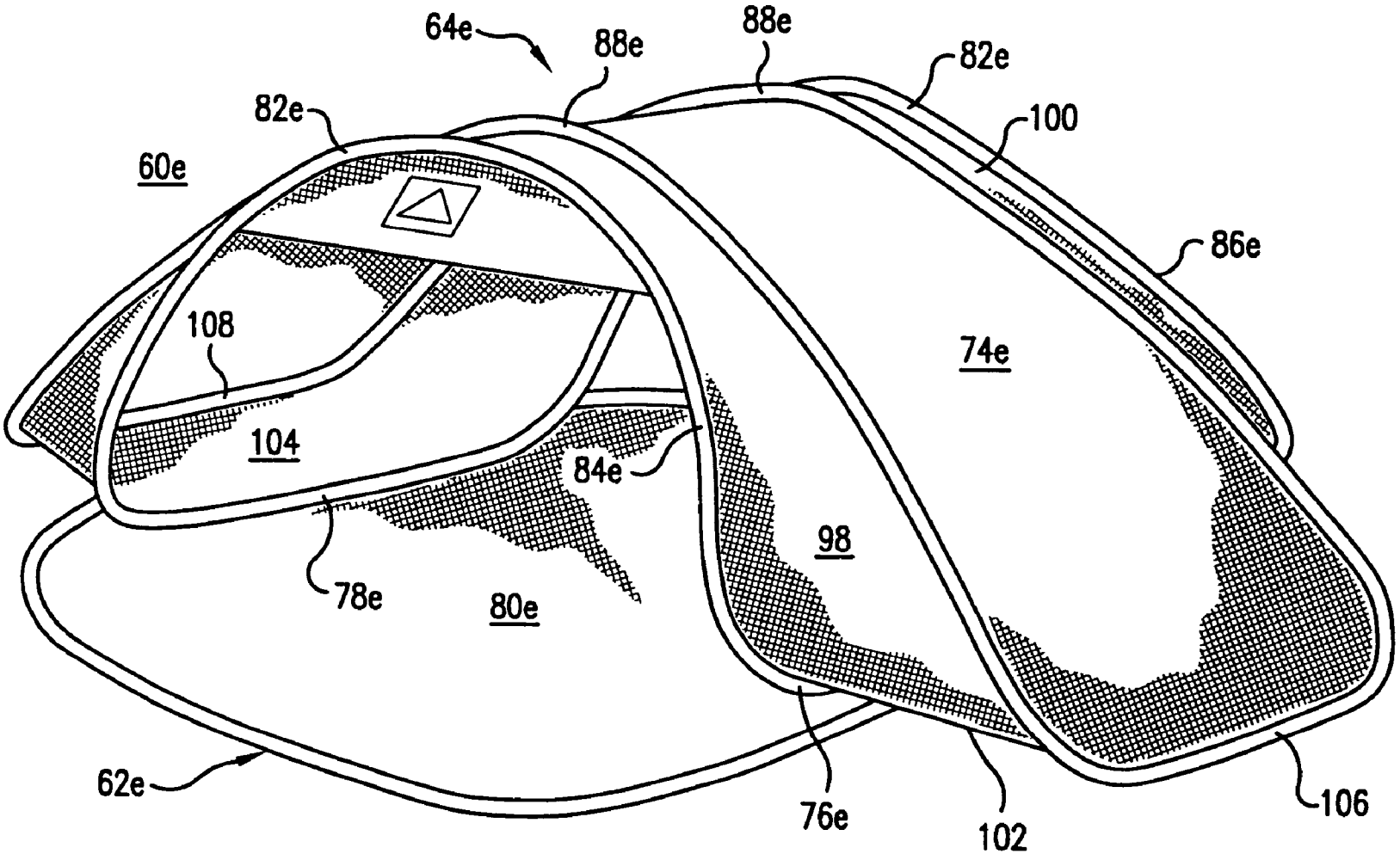
FIG. 9 is a perspective view of a collapsible structure according to an ninth embodiment of the present invention shown in use in its expanded configuration.

FIG. 9 illustrates a structure 60*e* according to a ninth embodiment of the present invention which is similar to structure 60*a* of FIG. 5A, except that the panel 64*e* has been modified to provide a larger internal space. The elements of the structure 60*e* that are the same as the elements of the structure 60*a* are provided with the same numeral designations except that an "e" has been added to the numeral designations in FIG. 9. The panel 64*e* also has two separate sleeves 82*e* and 88*e* that retain separate frame members 68*e* and 70*e*, and sleeve 82*e* is attached to fabric 80*e* of base panel 62*e* in the same manner as sleeve 82*a* is attached to fabric 80*a* of base panel 62*a*. However, sleeve 88*e* is not positioned entirely within the periphery defined by sleeve 82*e*, and instead extends outside the peripheries defined by both the sleeve 82*e* and the base panel 62*e*. Additional fabric pieces 98 and 100 extend from both outer sides of sleeve 88*e* to connect the first and second edges 84*e* and 86*e* of sleeve 82*e*, respectively, and additional floor fabric pieces 102 and 104 extend from the bottom end edges 106 and 108 of sleeve 88*e* across the outer periphery of the panel 62*e* to connect end edges 76*e* and 78*e*, respectively, of sleeve 82*e*. These additional fabric pieces 98, 100, 102, 104 define two additional enclosed spaces on opposing ends of the panels 62*e*, 64*e*, to widen the enclosed space between the panels 62*e* and 64*e* extending from the end edges 76*e*, 78*e*. The configuration of the panel 64*e* and its two frame members 68*e*, 70*e* also provide a widened base at the end edges 76*e*, 78*e*, 106 and 108 to further stabilize the structure 60*e*.

Figure 10A:
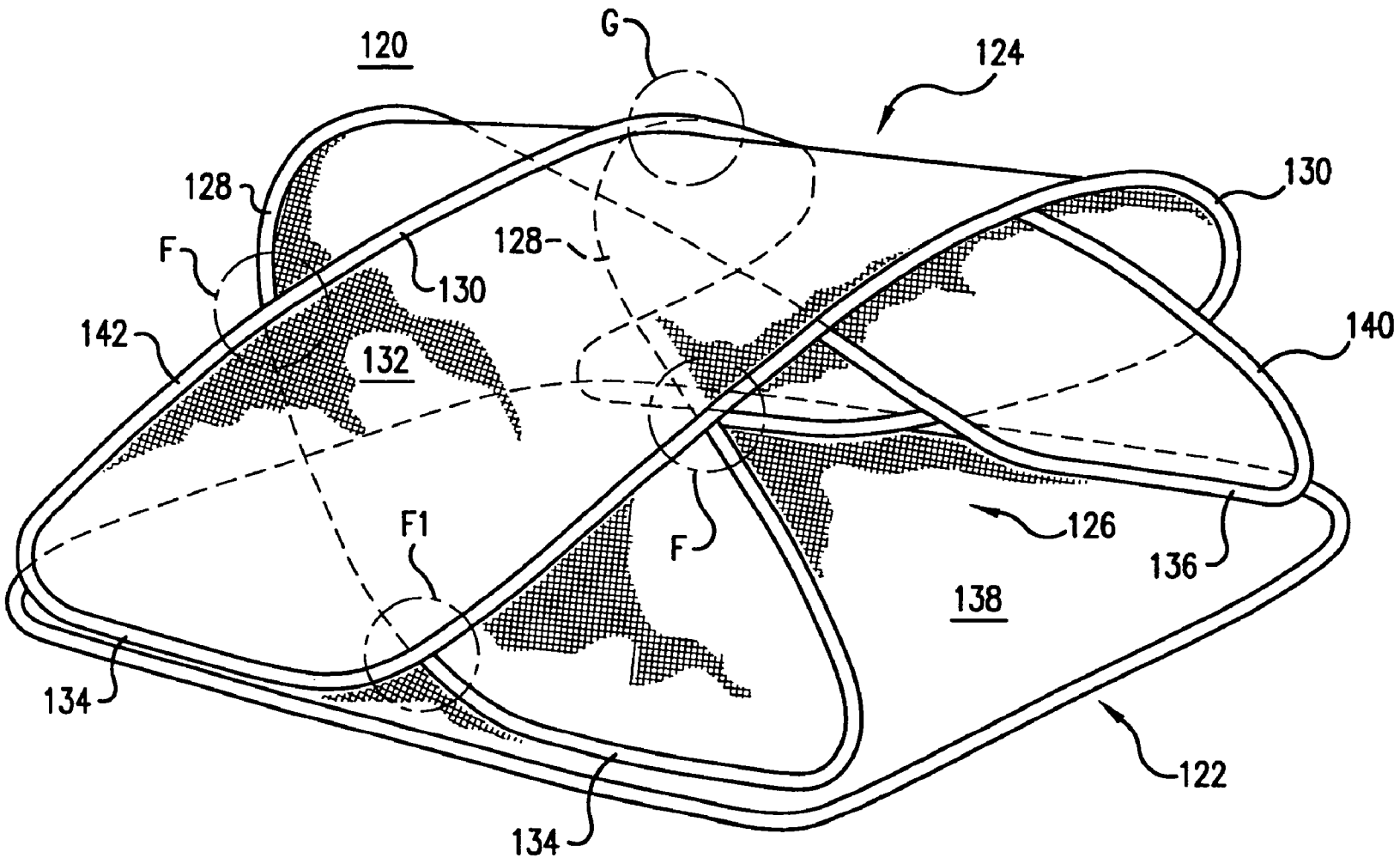
FIG. 10A is a perspective view of a collapsible structure according to a tenth embodiment of the present invention shown in use in its expanded configuration.

FIG. 10A illustrates a structure 120 according to a tenth embodiment of the present invention which is similar to the structures described above, but which orients the frame members in its top panel differently. The structure 120 has a base panel 122 that can be the same as the base panel 22 of structure 20. A top panel 124 is flexed and extends over the base panel 122 to enclose an internal space 126. The panel 124 is supported by a pair of angled overlapping or crossing frame members that are retained inside frame retaining sleeves 128 and 130. The panel 124 has a fabric piece 132 that substantially covers the area defined by the crossing sleeves 128 and 130. The panel 124 has opposing end edges 134 and 136 that are stitched to the fabric 138 of the base panel 122.

The first sleeve 128 extends at an angle from along a bottom part of a first edge 140 of the panel 124 up along the fabric 132 to a central top part of the fabric 132, then extends at a similar angle down the fabric 132 towards the bottom part of the first edge 140 at the other side of the panel 124. From there, the sleeve 128 extends along one end edge 136 of the panel 124 and then up along the fabric 132 at a generally parallel angle to a top part of a second edge 142 of the panel 124, where it then extends at a similar angle down the other side of the top part of the second edge 142 and along the fabric 132 towards the other end edge 134. Similarly, the second sleeve 130 extends at an angle from along a bottom part of the second edge 142 of the panel 124 up along the fabric 132 to a central top part of the fabric 132, then extends at a similar angle down the fabric 132 towards the bottom part of the second edge 142 at the other side of the panel 124. From there, the sleeve 128 extends along end edge 136 of the panel 124 and then up along the fabric 132 at a generally parallel angle to a top part of the first edge 140 of the panel 124, where it then extends at a similar angle down the other side of the top part of the first edge 140 and along the fabric 132 towards the other end edge 134.

Thus, portions of the sleeves 128 and 130 define the outer periphery of the panel 124, with the sleeve 128 defining the top part of the second edge 142 and the bottom part of the first edge 140, and the sleeve 130 defining the top part of the first edge 140 and the bottom part of the second edge 142. In addition, the sleeves 128, 130 each extend along a portion of the end edges 134, 136: the sleeve 128 extending along the end edges 134, 136 adjacent the first edge 140, and the sleeve 130 extending along the end edges 134, 136 adjacent the second edge 142. In this manner, the angled frame members 146, 148 (see FIGS. 10B and 10C) for the panel 124 can be considered to be positioned in a side-by-side and crossing manner.

Moreover, the sleeves 128 and 130 are positioned at generally opposite angles to each other. Because of this opposing angled configuration, the sleeves 128 and 130 cross each other at a few other locations. First, the sleeves 128 and 130 cross or overlap each other at the opposing locations circled by the label "F" adjacent the first and second edges 140, 142, with the structure at these crossing locations being the same as that illustrated in FIG. 8B. The top and bottom parts of the first and second edges 140, 142 are defined by these crossing locations. Second, the sleeves 128 and 130 also cross or overlap each other at the locations circled by the label "F1" adjacent the end edges 134, 136, with the structure at these crossing locations being about the same as that illustrated in FIG. 8B (except that the fabric piece may be positioned differently).

Figure 10B:
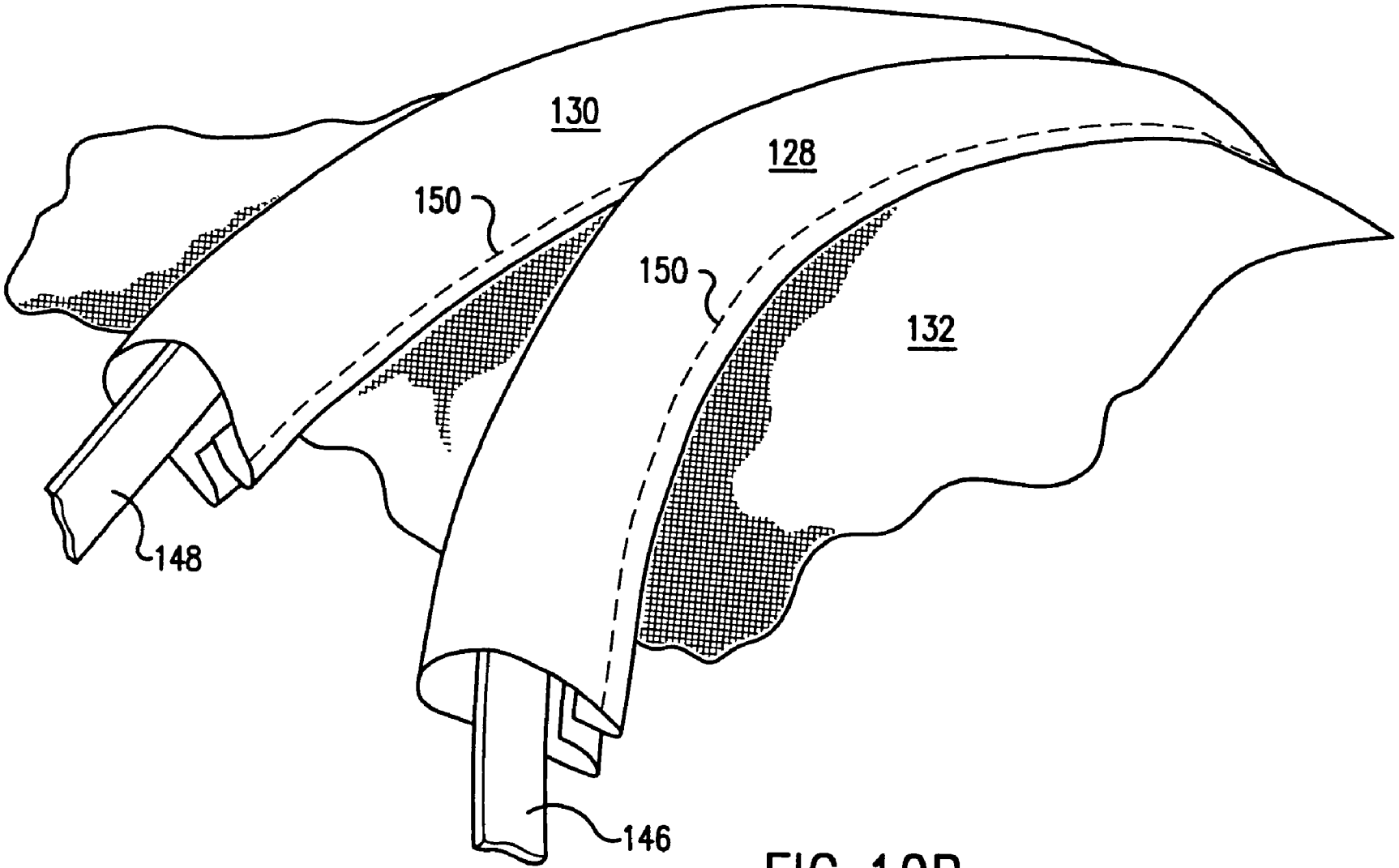
FIG. 10B is a partial cut-away view of the section G of the structure of FIG. 10A according to one embodiment.
Figure 10C:
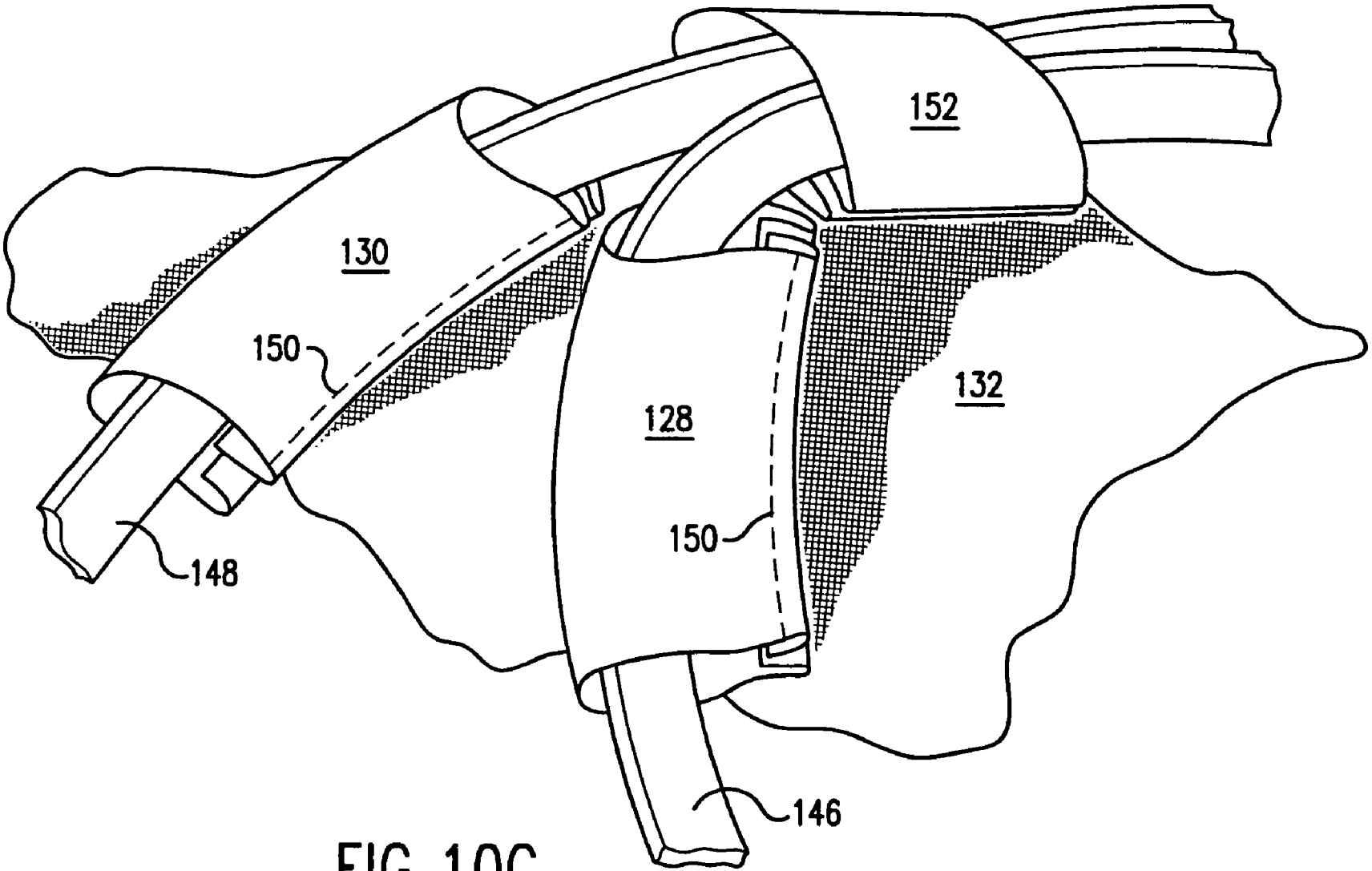
FIG. 10C is a partial cut-away view of the section G of the structure of FIG. 10A according to another embodiment.

One possible configuration for the sleeves 128, 130 and fabric 132 at the top central portion labeled "G" is illustrated in FIG. 10B. The sleeves 128 and 130 retain separate frame members 146 and 148, respectively, and the sleeves 128, 130 can be stitched (see stitch lines 150) to the fabric 132 adjacent each other. FIG. 10C illustrates an alternative configuration, in which the separate sleeves 128, 132 converge at the top central portion G to form a single sleeve 152 that retains both frame members 146, 148. The single sleeve 152 only extends along the top central portion G before diverging to the two separate sleeves 128, 130 on the other side. As shown in FIG. 10C, openings (i.e., interrupted portions of the sleeve) can be provided in the sleeves 128, 130 adjacent both sides of the single sleeve 152, or the portion of each sleeve 128, 130 adjacent the single sleeve 150 can be stitched together to join or communicate with the single sleeve 150.

To assemble the structure 120, the base panel 122 is first provided in a manner similar to that for base panel 22. The fabric 132 is cut to its desired shape and then formed with its sleeves 128, 130 (and possibly 152), such as by stitching the sleeves to the fabric 132. Thereafter, one frame member 146 is provided in the form of a strip of coilable material, and one end of the frame member 146 is inserted through the sleeve 128 via the opening adjacent the single sleeve 152, or anywhere along the sleeve 128. When the entire frame member 146 extends through the lumen of the sleeve 128, the ends of the frame member 146 are connected. The second frame member 148 can be provided and inserted into the second sleeve 130 in the same manner. The panel 124 is then flexed and its end edges 134, 136 attached (such as by stitching) to the fabric 138 to obtain the structure 120 shown in FIG. 10A.

The configuration of the top panel 124 provides the structure 120 with stronger support and stability to enable wider top panels 124 to be provided. The frame members 146, 148 cross at numerous locations, thereby imparting support and stability to these various locations along the top panel 124.

Figure 11A:
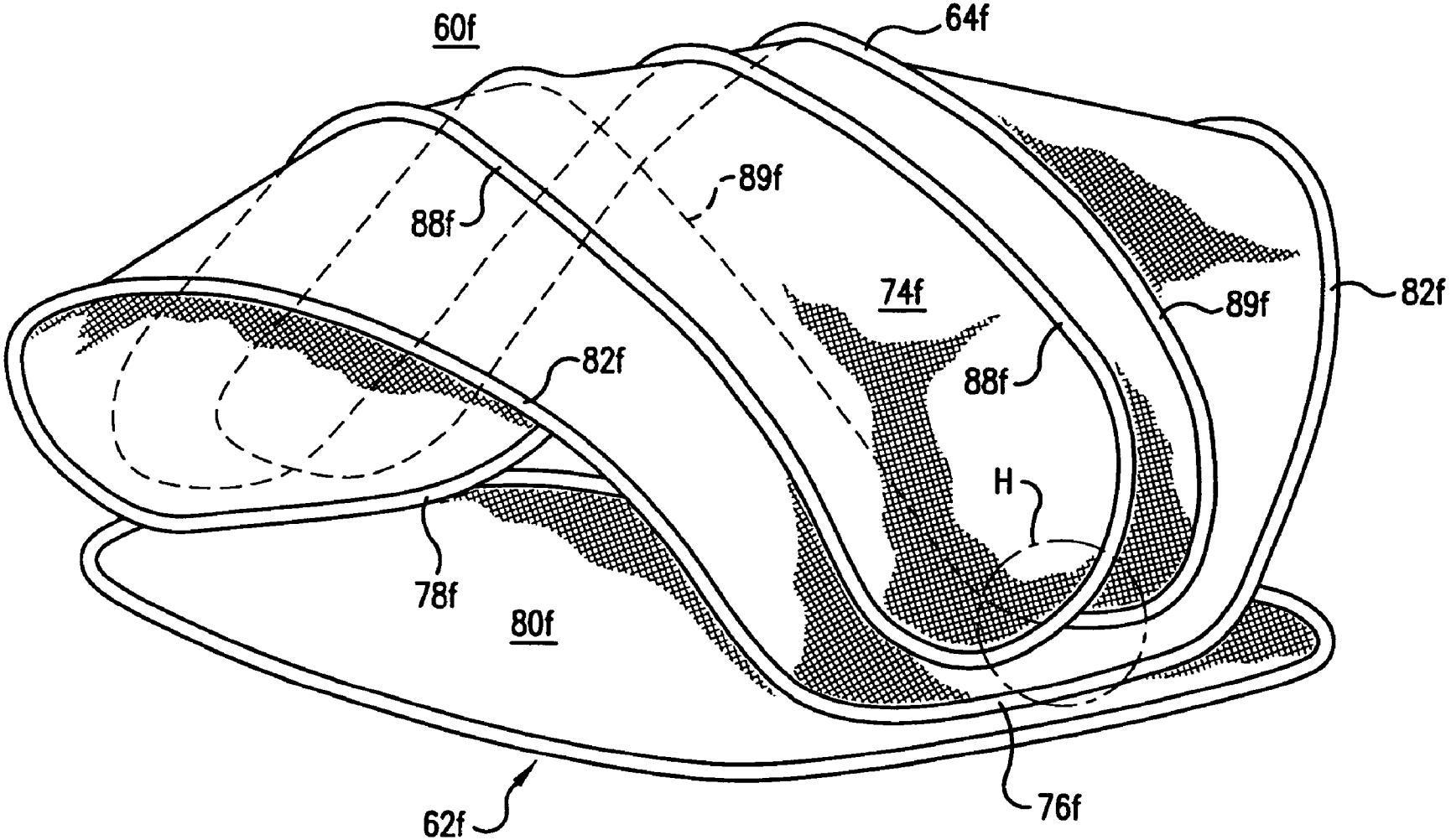
FIG. 11A is a perspective view of a collapsible structure according to an eleventh embodiment of the present invention shown in use in its expanded configuration.
Figure 11B:
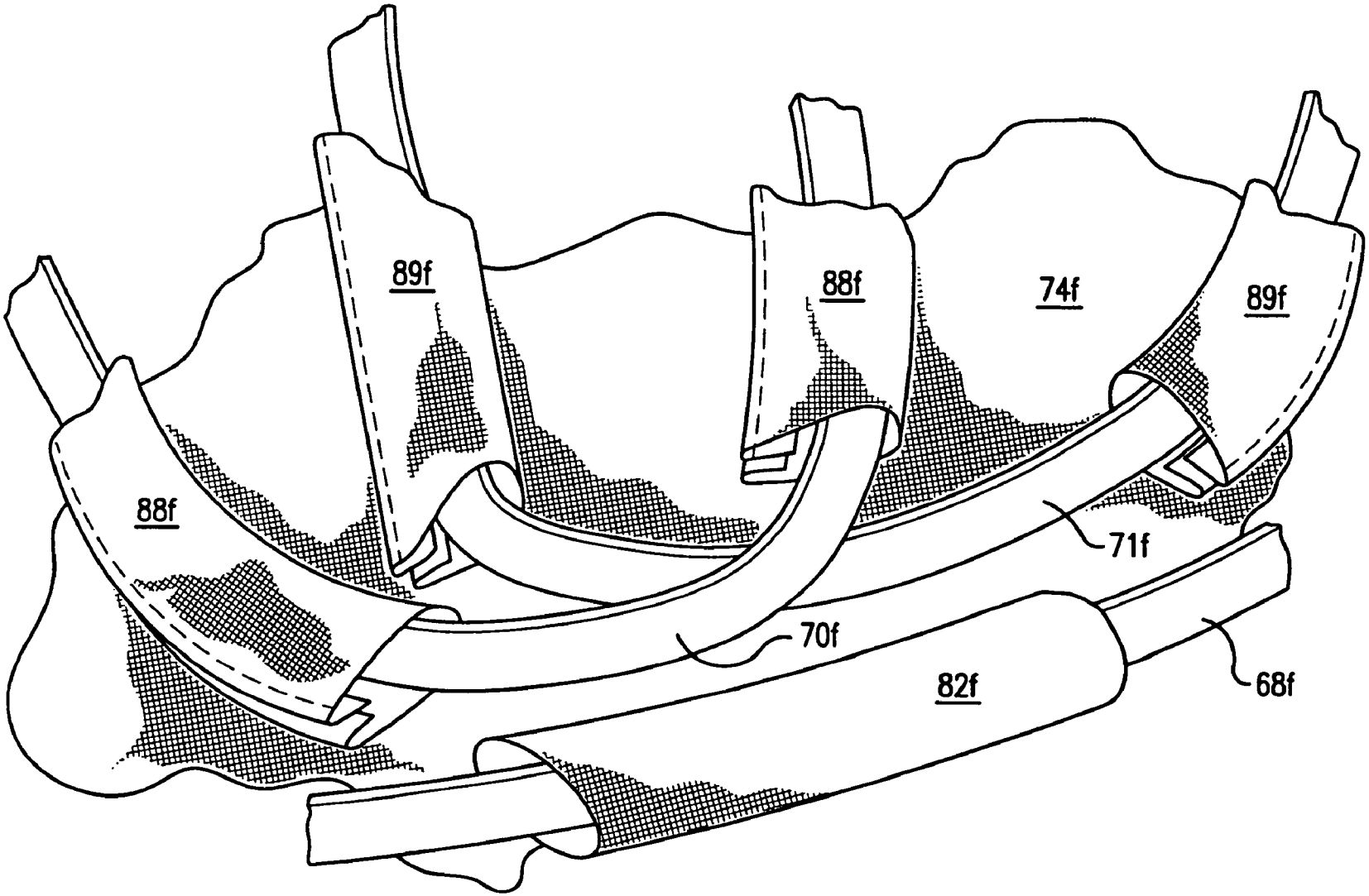
FIG. 11B is a partial cut-away view of the section H of the is structure of FIG. 11A.

The top panel of the present invention can be supported by more than two frame members. FIGS. 11A and 11B illustrate a structure 60*f* according to an eleventh embodiment of the present invention which is similar to structure 60*a* of FIG. 5A, except that the panel 64*f* is supported by three frame members. The elements of the structure 60*f* that are the same as the elements of the structure 60*a* are provided with the same numeral designations except that an "f" has been added to the numeral designations in FIGS. 11A and 11B. The panel 64*f* has an outer sleeve 82*f*, but the one internal sleeve 88*a* is now replaced by two crossing or overlapping sleeves 88*f* and 89*f* that can be stitched to the fabric 74*f*. Each sleeve 82*f*, 88*f* and

89*f* retains a separate frame member 68*f*, 70*f* and 71*f*, respectively. Sleeve 82*f* is attached to fabric 80*f* of base panel 62*f* in the same manner as sleeve 82*a* is attached to fabric 80*a* of base panel 62*a*. Referring to FIG. 11B, a portion of each sleeve 88*f*, 89*f* adjacent the crossing location can be interrupted (or an opening defined) so that the frame members 70*f*, 71*f* are exposed thereat.

Providing three frame members 68*f*, 70*f*, 71*f* to support the panel 64*f* allows a wider and higher panel 64*f* to be provided, thereby rendering the structure 60*f* well-suited for use in camping or other applications where a structure defining a large interior space is desired. As shown in FIG. 11A, the peripheral or outer frame member 68*f* spans a larger area, with the two inner frame members 70*f*, 71*f* providing the necessary support to the inner portions of the fabric 74*f*, and to raise the height of the fabric 74*f*. Without the support of the inner frame members 70*f*, 71*f*, the outer frame member 68*f* would be too flimsy to support a fabric 74*f* having such a large width and height.

Figure 12:
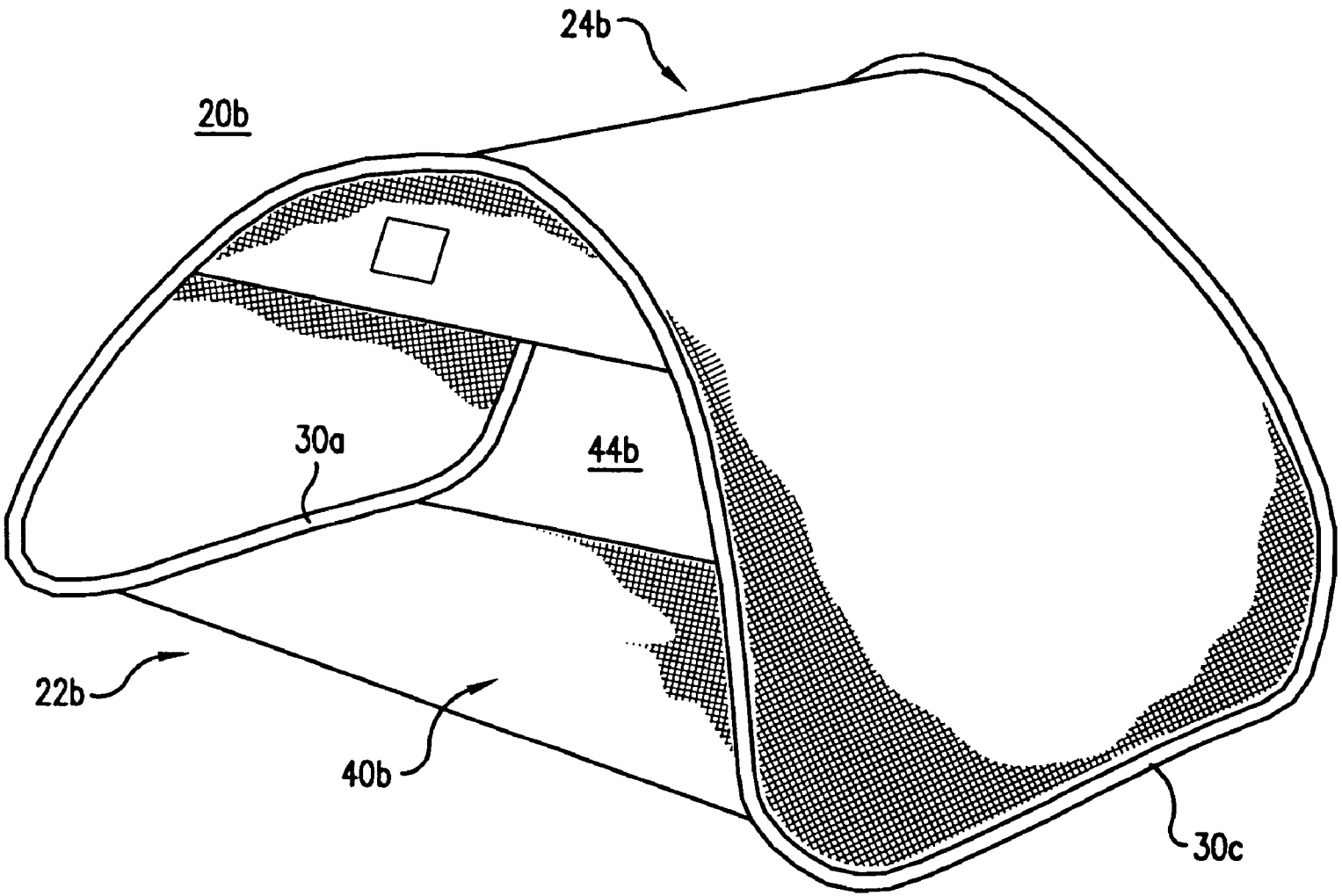
FIG. 12 is a perspective view of a collapsible structure according to a twelfth embodiment of the present invention shown in use in its expanded configuration.

The structures of the present invention can even be provided without the base panel. In the simplest example, the structure 20 of FIG. 1 can be modified to provide the structure 20*b* in FIG. 12 where the base panel 22 is replaced by merely a fabric piece 20*b* that is attached (such as by stitching) to the end edges 30*a*, 30*c* of the top panel 24*b*. The elements of the structure 20*b* that are the same as the elements of the structure 20 are provided with the same numeral designations except that a "b" has been added to the numeral designations in FIG. 12. The fabric 40*b* can be replaced by a plurality of straps or thin pieces of fabric that have opposing ends connected to the end edges 30*a*, 30*c* of the top panel 24*b*. The fabric 40*b* or plurality of straps perform the same function of holding the panel 24*b* in the flexed configuration.

Figure 13:
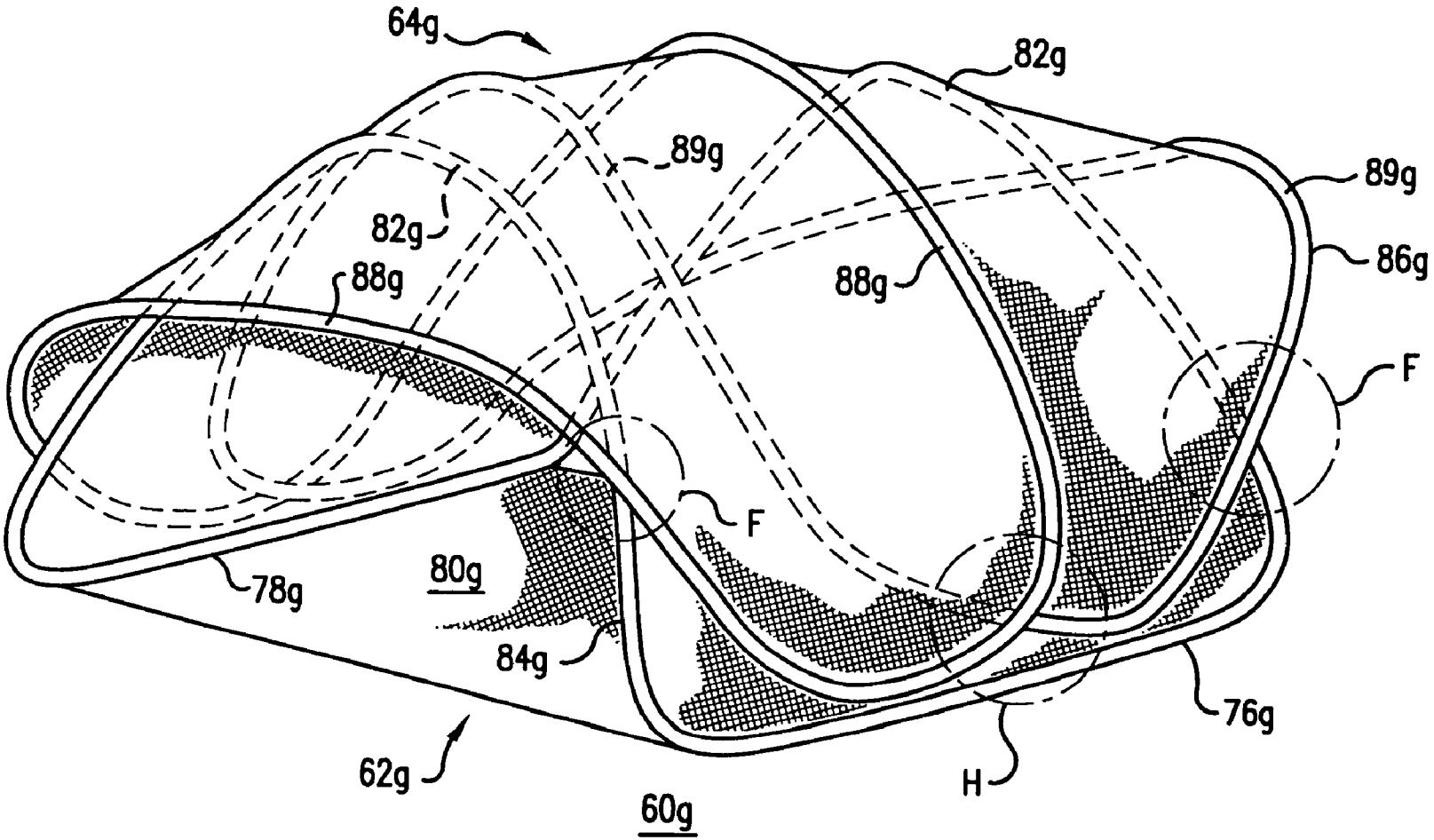
FIG. 13 is a perspective view of a collapsible structure according to a thirteenth embodiment of the present invention shown in use in its expanded configuration.

This principle is further illustrated by the structure 60*g* in FIG. 13, which is similar to structure 60*f* of FIG. 11A, except that (1) the base panel 62*f* has been replaced by merely a fabric piece 80*g* that is attached (such as by stitching) to the end edges 76*g*, 78*g* of the top panel 64*g*, and (2) the crossing sleeves 88*g*, 89*g* also overlap or cross with the sleeve 82*g*. The elements of the structure 60*g* that are the same as the elements of the structure 60*f* are provided with the same numeral designations except that a "g" has been added to the numeral designations in FIG. 13.

The sleeves 82*g* and 88*g* cross or overlap at two opposing locations on the first edge 84*g*, so that the sleeve 82*g* defines a bottom portion of the first edge 84*g* and the sleeve 88*g* defines a top portion of the first edge 84*g*. Similarly, the sleeves 82*g* and 89*g* cross or overlap at two opposing locations on the second edge 86*g*, so that the sleeve 82*g* defines a bottom portion of the second edge 86*g* and the sleeve 89*g* defines a top portion of the second edge 86*g*. The configuration at the overlapping locations labeled "F" can be the same as that illustrated in FIG. 8B. In addition, the configuration at the location labeled "H" where the sleeves 88*g*, 89*g* overlap can be the same as illustrated in FIG. 11B. Crossing or overlapping the three sleeves 82*g*, 88*g*, 89g, and their respective frame members, in the manner illustrated in FIG. 13 provides more support to the structure 60*g* since the overlapping locations function to provide improved structural stability. This point is true for all the other structures in the present invention where frame members overlap. In addition, the top portions of the first and second edges 84*g* and 86*g* defined by the sleeves 88*g* and 89*g*, respectively, can extend over a wider or larger area (i.e., like a canopy) than that which is covered by the floor fabric 80*g*.

Figures 14A, 14B:
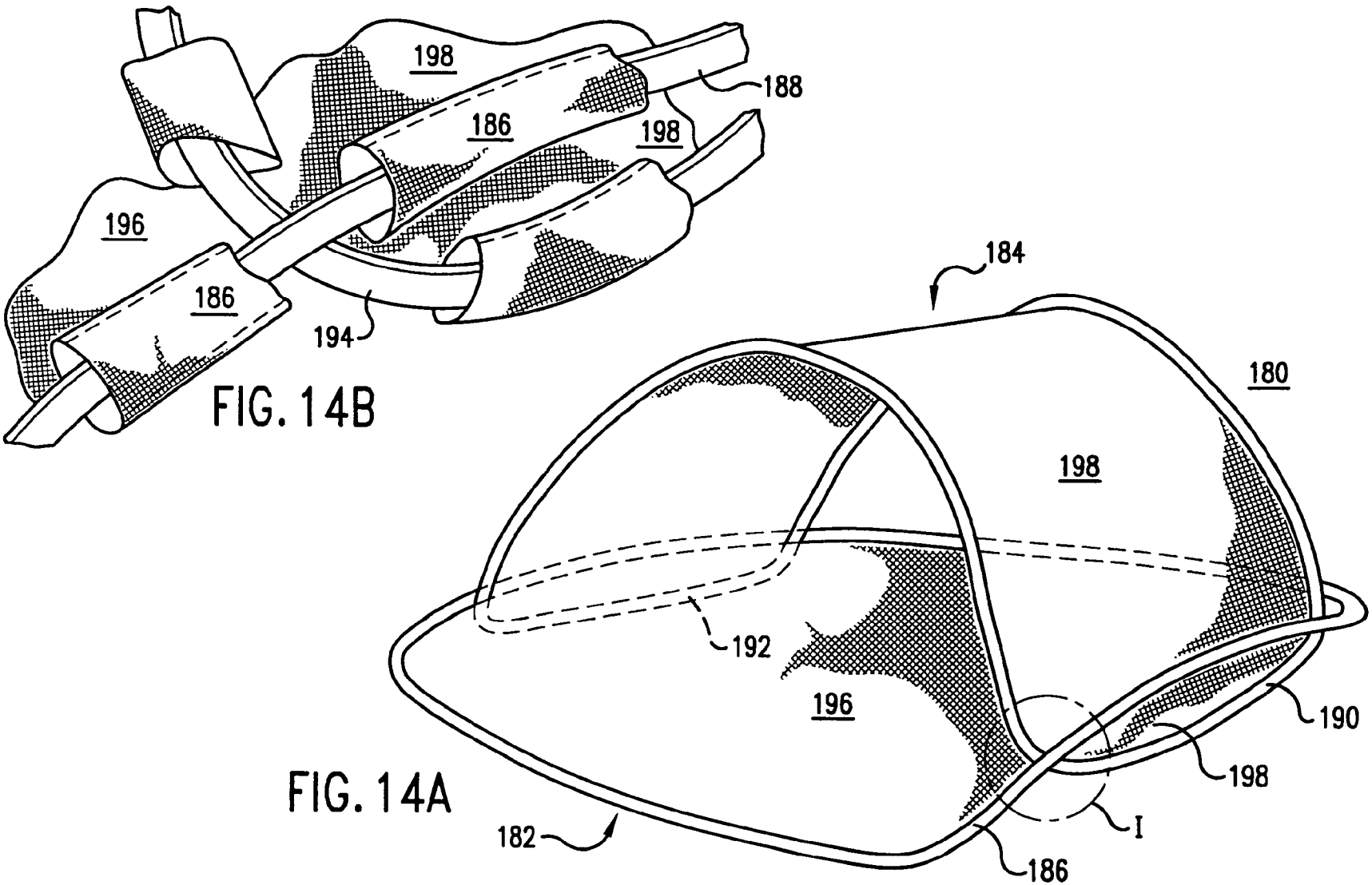
FIG. 14A is a perspective view of a collapsible structure according to a fourteenth embodiment of the present invention shown in use in its expanded configuration.
FIG. 14B is a partial cut-away view of the section I of the structure of FIG. 14A.

FIG. 14A illustrates a structure 180 according to a fourteenth embodiment of the present invention which is similar to structures 20 and 20*a* of FIGS. 1A and 2A, respectively, except that the panels 182 and 184 are connected in a different manner. The panels 182 and 184 are similar to panels 22 and 24, respectively. In structure 180, the base panel 182 is slightly raised so that the flexed top panel 184 is fitted inside the periphery of the sleeve 186 and frame member 188 of the base panel 182. Referring also to FIG. 14B, the two opposing end edges 190 and 192 (shown in phantom) of the top panel 184 extend vertically lower than the sleeve 186 and contact the ground or surface on which the structure 180 is rested. The frame members 194 (of the panel 184) and 188 also cross each other at two locations adjacent each end edge 190 and 192. The fabric 196 of the base panel 182 is stitched to the fabric 198 of the top panel 184 adjacent the sleeve 186.

The structure 180 can be assembled by first providing the two panels 182, 184 separately. The panel 182 can be initially provided without its fabric 196, so that the flexed panel 184 can be fitted inside the periphery of the sleeve 186 and its frame member 188. After the panel 184 has been positioned within the periphery of the sleeve 186, the fabric 196 of panel 182 is stitched to the sleeve 186 and the fabric 198 of panel 184. The structure 180 can be folded and collapsed, and re-opened, according to principles described above in connection with FIGS. 4A-4D.

The structures illustrated herein are examples of simple structures that can be provided according to the present invention. However, it will be appreciated by those skilled in the art that structures having different and more complex configurations can also be provided according to the principles of the present invention. For example, even though the top panel in each of the above structures has been described as having one fabric piece, it is possible to provide a plurality of fabric pieces, especially where two or more sleeves are provided on the top panel. Referring for example to FIG. 11A, five different pieces of fabric 74*f* can be provided between the spaces defined by the sleeves 82*f*, 88*f* and 89*f*.

As another non-limiting example, while the panels of the structures according to the present invention are shown and described as having four sides, it is possible for each panel to have three or more sides. It is also possible to provide the panels of a given structure with a different configuration (e.g., a different shape, size, or number of sides). Thus, the structures of the present invention may take a variety of external shapes and sizes. In addition, the principles illustrated in one or more embodiments herein can be combined to provide different structures. For example, the principles of FIGS. 2B and 5A can be combined to provide a structure having two top panels, each of which has the configuration of top panel 64*a* shown in FIG. 5A. As yet another non-limiting example, one or both of the end edges of the top panel can be attached to the fabric of the base panel by a removable attachment mechanism, such as opposing VelcroTM pads, opposing hooks, straps or similar mechanisms.

Figure 15:
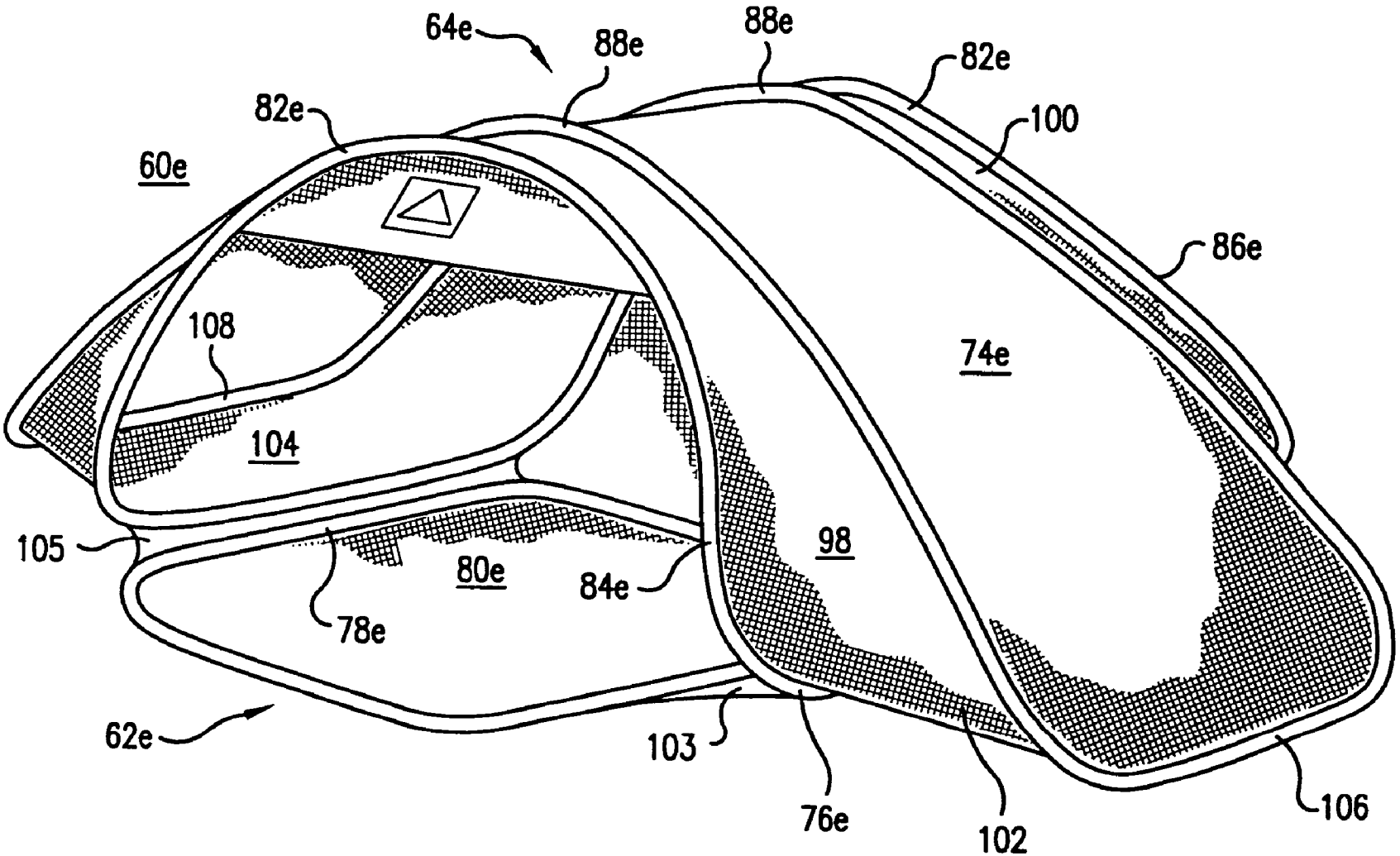
FIG. 15 illustrates a modification to the structure of FIG. 9.

As yet a further non-limiting example, the structure 60*e* of FIG. 9 can be modified so that the end edges 76*e* and 78*e* are coupled to the panel 62*e* by two interconnecting fabric pieces 103 and 105, respectively, (as shown in FIG. 15) that use the same principles as the interconnecting fabric pieces 32 and 34 of FIG. 1. The structures shown in FIGS. 9 and 15 are essentially the same, except for the use of the interconnecting fabric pieces 103 and 105 in FIG. 15 to couple the end edges 76*e*, 78*e* to the panel 62*e*, instead of merely stitching the end edges 76*e*, 78*e* to the fabric 80*e* of the panel 62*e*.

Figure 16:
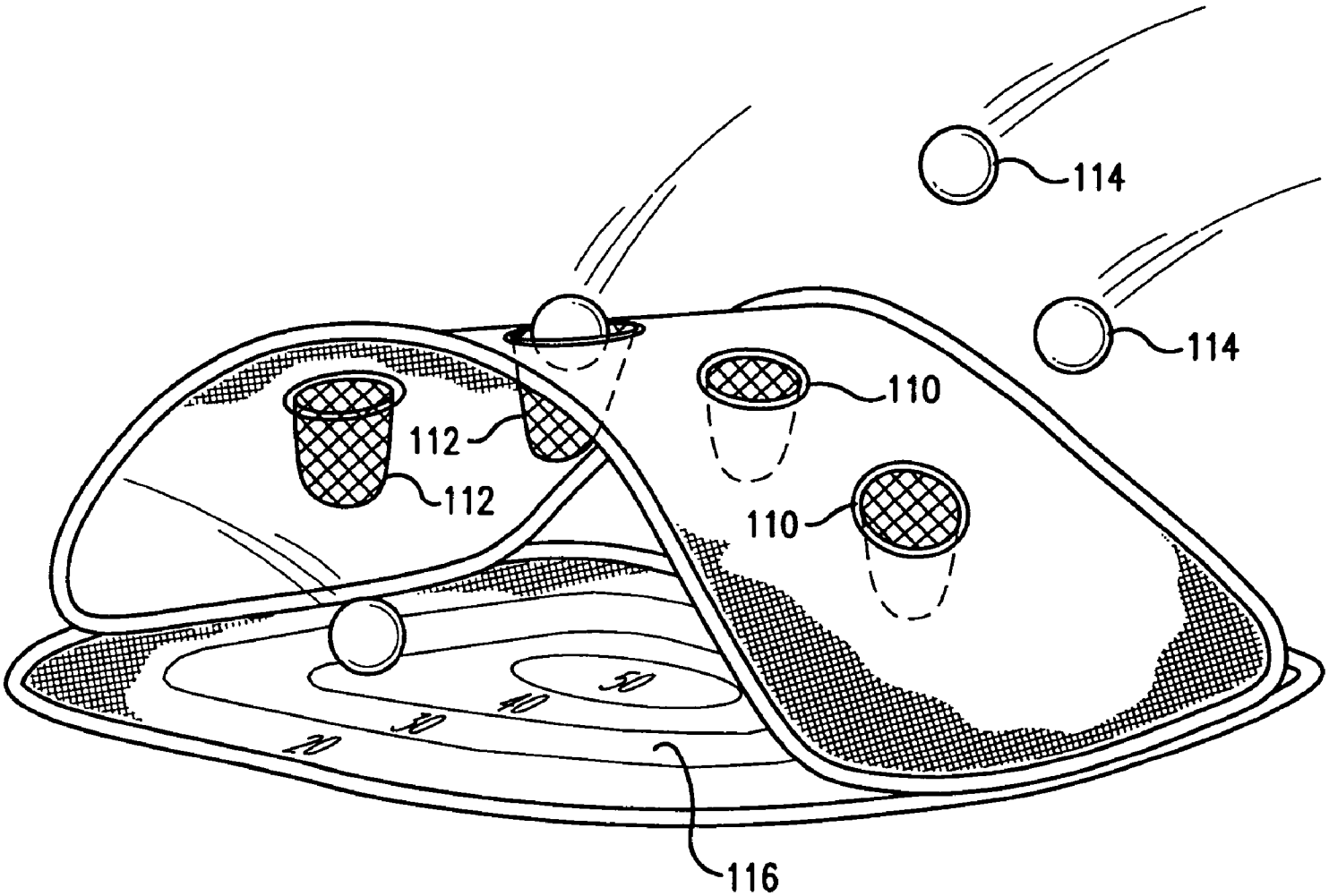
FIG. 16 illustrates a possible enhancement to the structures described herein.

FIG. 16 illustrates an enhancement that can be made to the structures described herein. As shown in FIG. 16, one or more openings 110 can be provided in the top panel, and baskets or nets 112 provided thereat, so that the user can toss balls or objects 114 at these nets 112. In addition, the base panel can have game indicia 116 provided thereon to facilitate use as a game board. The structure and its top panel and base panel shown in FIG. 16 are illustrated in a generic sense, since the nets 112 and indicia 116 can be provided to any of the structures described herein. These enhancements provide additional variety, utility and fun to the structures, which can be used as game structures.

Thus, the structures according to the present invention may be provided in a variety of configurations in which the number of panels and the shape and size of the panels may be varied. The principles of the present invention can be employed to provide support and stability at certain desired locations to vary the shapes and sizes of the resulting structures. The structures according to the present invention can be easily deployed and disassembled, and are easy to fold and collapse into a compact configuration for convenient storage or transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a first base panel having a foldable frame member that has a folded and an unfolded orientation, and a material partially covering the frame member when the frame member is in the unfolded orientation, with the material assuming the unfolded orientation of its associated frame member, the first panel having an outer periphery; and a second panel having first and second foldable frame members, each having a folded and an unfolded orientation, and a material partially covering the frame members when the frame members are in the unfolded orientation, with the material assuming the unfolded orientation of the frame members, the second panel being flexed so that the first and second panels define an interior space, with the second panel having opposing first and second end edges that are coupled to the first panel adjacent the outer periphery;

wherein the first and second frame members are spaced apart from each other at all points thereof, and with the second frame member lying within the periphery of the first frame member.

2. A collapsible structure, comprising:

a first base panel having a foldable frame member that has a folded and an unfolded orientation, and a material partially covering the frame member when the frame member is in the unfolded orientation, with the material assuming the unfolded orientation of its associated frame member, the first panel having an outer periphery; and a second panel having first and second foldable frame members, each having a folded and an unfolded orientation, and a material partially covering the frame members when the frame members are in the unfolded orientation, with the material assuming the unfolded orientation of the frame members, the second panel being flexed so that the first and second panels define an interior space, with the second panel having opposing first and second end edges that are coupled to the first panel adjacent the outer periphery;

wherein the second panel has a first side edge and an opposing second side edge, with the first and second frame members crossing each other at opposing locations along the first side edge and along the second side edge.

3. The structure of claim 2, wherein the first side edge and the second side edge are each defined by a portion of the first sleeve and a portion of the second sleeve.

* * * * *